US009494890B2

(12) United States Patent
Komatsu et al.

(10) Patent No.: US 9,494,890 B2
(45) Date of Patent: Nov. 15, 2016

(54) DEVELOPING CARTRIDGE, PROCESS CARTRIDGE AND IMAGE FORMING APPARATUS

(71) Applicant: CANON KABUSHIKI KAISHA, Tokyo (JP)

(72) Inventors: Noriyuki Komatsu, Numazu (JP); Yoshiyuki Batori, Hiratsuka (JP); Toshiaki Takeuchi, Susono (JP); Daisuke Makiguchi, Izunokuni (JP); Takatoshi Hamada, Mishima (JP); Koji Yamaguchi, Numazu (JP); Hiroomi Matsuzaki, Mishima (JP); Masaaki Matsushita, Yokohama (JP); Junichi Matsumura, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 82 days.

(21) Appl. No.: 14/421,274

(22) PCT Filed: Aug. 26, 2013

(86) PCT No.: PCT/JP2013/073462

§ 371 (c)(1),
(2) Date: Feb. 12, 2015

(87) PCT Pub. No.: WO2014/038495

PCT Pub. Date: Mar. 13, 2014

(65) Prior Publication Data

US 2015/0205226 A1 Jul. 23, 2015

(30) Foreign Application Priority Data

Sep. 10, 2012 (JP) ..... 2012-198089
Jun. 11, 2013 (JP) ..... 2013-122573

(51) Int. Cl.
*G03G 15/08* (2006.01)
*G03G 15/22* (2006.01)

(52) U.S. Cl.
CPC ..... *G03G 15/0874* (2013.01); *G03G 15/22* (2013.01); *G03G 2215/0682* (2013.01)

(58) Field of Classification Search
CPC ..... G03G 15/0874; G03G 2215/0682
See application file for complete search history.

(56) References Cited

U.S. PATENT DOCUMENTS 4,000,833 A * 1/1977 Marks ..... G03G 15/0891 222/105
5,075,727 A * 12/1991 Nakatomi ..... G03G 15/0896 399/103

(Continued)

FOREIGN PATENT DOCUMENTS

EP 1 115 036 A1 7/2001
JP 07-044006 2/1992

(Continued)

OTHER PUBLICATIONS

Written Opinion of the International Searching Authority and International Search Report in PCT/JP2013/073462.

(Continued)

*Primary Examiner* — Sandra Brase
(74) *Attorney, Agent, or Firm* — Fitzpatrick, Cella, Harper & Scinto

(57) ABSTRACT

A developing cartridge includes: a flexible developer bag, provided with an opening and provided in a frame, for accommodating a developer; and an acting member contactable to the developer bag. The developer bag is fixed to the frame at its upper portion. The developer bag is swingable by contact with the acting member.

15 Claims, 20 Drawing Sheets

(56) References Cited

U.S. PATENT DOCUMENTS

| | | | |
|---|---|---|---|
| 5,079,591 | A | 1/1992 | Tomita et al. |
| 5,559,581 | A | 9/1996 | Sugiura et al. |
| 5,561,496 | A | 10/1996 | Sugiura et al. |
| 5,634,178 | A | 5/1997 | Sugiura et al. |
| 5,911,096 | A | 6/1999 | Batori et al. |
| 5,920,753 | A | 7/1999 | Sasaki et al. |
| 5,930,562 | A | 7/1999 | Noda et al. |
| 5,937,237 | A | 8/1999 | Nonaka et al. |
| 5,940,658 | A | 8/1999 | Yokoi et al. |
| 5,943,529 | A | 8/1999 | Miyabe et al. |
| 5,966,567 | A | 10/1999 | Matsuzaki et al. |
| 6,011,941 | A | 1/2000 | Takashima et al. |
| 6,075,957 | A | 6/2000 | Batori et al. |
| 6,084,622 | A | 7/2000 | Sugiura et al. |
| 6,097,906 | A | 8/2000 | Matsuzaki et al. |
| 6,101,348 | A | 8/2000 | Nonaka et al. |
| 6,131,007 | A | 10/2000 | Yamaguchi et al. |
| 6,144,815 | A | 11/2000 | Chadani et al. |
| 6,173,140 | B1 | 1/2001 | Suzuki et al. |
| 6,173,145 | B1 | 1/2001 | Chadani et al. |
| 6,205,305 | B1 | 3/2001 | Suzuki et al. |
| 6,219,504 | B1 | 4/2001 | Matsuzaki et al. |
| 6,275,668 | B1 | 8/2001 | Batori |
| 6,282,389 | B1 | 8/2001 | Matsuzaki et al. |
| 6,334,035 | B1 | 12/2001 | Abe et al. |
| 6,363,226 | B1 | 3/2002 | Batori |
| 6,405,004 | B2 | 6/2002 | Matsuzaki et al. |
| 6,549,736 | B2 | 4/2003 | Miyabe et al. |
| 6,671,477 | B2 | 12/2003 | Komatsu et al. |
| 6,681,088 | B2 | 1/2004 | Kanno et al. |
| 6,714,746 | B2 | 3/2004 | Morioka et al. |
| 6,782,219 | B2 | 8/2004 | Yoshino et al. |
| 6,792,229 | B2 | 9/2004 | Matsuzaki |
| 6,795,666 | B2 | 9/2004 | Miyabe et al. |
| 6,834,173 | B2 | 12/2004 | Yamaguchi et al. |
| 6,915,092 | B2 | 7/2005 | Yamaguchi et al. |
| 6,931,226 | B2 | 8/2005 | Chadani et al. |
| 6,934,485 | B2 | 8/2005 | Miyabe et al. |
| 6,937,832 | B2 | 8/2005 | Sato et al. |
| 6,947,687 | B2 | 9/2005 | Yamaguchi et al. |
| 6,961,528 | B2 | 11/2005 | Yamaguchi et al. |
| 6,963,706 | B2 | 11/2005 | Morioka et al. |
| 6,983,115 | B2 | 1/2006 | Isobe et al. |
| 7,024,131 | B2 | 4/2006 | Komatsu et al. |
| 7,068,965 | B2 | 6/2006 | Yoshino et al. |
| 7,079,787 | B2 | 7/2006 | Ogino et al. |
| 7,110,703 | B2 | 9/2006 | Uratani et al. |
| 7,116,925 | B2 | 10/2006 | Yamaguchi |
| 7,127,192 | B2 | 10/2006 | Batori et al. |
| 7,136,604 | B2 | 11/2006 | Chadani et al. |
| 7,156,797 | B2 | 1/2007 | Komatsu et al. |
| 7,184,687 | B2 | 2/2007 | Yamaguchi et al. |
| 7,194,225 | B2 | 3/2007 | Yamaguchi |
| 7,200,349 | B2 | 4/2007 | Sato et al. |
| 7,224,925 | B2 | 5/2007 | Sato et al. |
| 7,266,326 | B2 | 9/2007 | Karakama et al. |
| 7,283,765 | B2 | 10/2007 | Uratani et al. |
| 7,319,834 | B2 | 1/2008 | Yamaguchi |
| 7,349,657 | B2 | 3/2008 | Sato et al. |
| 7,412,193 | B2 | 8/2008 | Sato et al. |
| 7,418,225 | B2 | 8/2008 | Morioka et al. |
| 7,477,865 | B2 | 1/2009 | Yamaguchi |
| 7,519,310 | B2 | 4/2009 | Yamaguchi et al. |
| 7,792,460 | B2 | 9/2010 | Yamaguchi et al. |
| 7,885,575 | B2 | 2/2011 | Batori et al. |
| 8,081,898 | B2 | 12/2011 | Batori et al. |
| 8,121,519 | B2 | 2/2012 | Yamaguchi et al. |
| 8,326,185 | B2 | 12/2012 | Asanuma et al. |
| 8,406,656 | B2 | 3/2013 | Batori et al. |
| 8,565,640 | B2 | 10/2013 | Batori et al. |
| 8,571,445 | B2 | 10/2013 | Komatsu et al. |
| 8,577,252 | B2 | 11/2013 | Anan et al. |
| 8,644,732 | B2 | 2/2014 | Kikuchi et al. |
| 8,676,085 | B1 | 3/2014 | Batori et al. |
| 8,787,794 | B2 | 7/2014 | Miyazaki et al. |
| 8,867,955 | B2 | 10/2014 | Yamaguchi et al. |
| 8,918,017 | B2 | 12/2014 | Matsushita et al. |
| 8,942,592 | B2 | 1/2015 | Uratani et al. |
| 2001/0017998 | A1 | 8/2001 | Terazawa et al. |
| 2011/0064478 | A1 | 3/2011 | Yamaguchi et al. |
| 2012/0027457 | A1 | 2/2012 | Yamaguchi et al. |
| 2013/0164039 | A1 | 6/2013 | Matsushita et al. |
| 2013/0164040 | A1 | 6/2013 | Matsushita et al. |
| 2013/1064039 | | 6/2013 | Matsushita et al. |
| 2013/0336679 | A1 | 12/2013 | Furutani et al. |
| 2013/0343785 | A1 | 12/2013 | Matsuzaki et al. |
| 2014/0016961 | A1 | 1/2014 | Yasui et al. |
| 2014/0029974 | A1 | 1/2014 | Uesugi et al. |
| 2014/0064793 | A1 | 3/2014 | Matsuzaki et al. |
| 2014/0072329 | A1 | 3/2014 | Uesugi et al. |
| 2014/0072331 | A1 | 3/2014 | Matsushita et al. |
| 2014/0072345 | A1 | 3/2014 | Matsunaga et al. |
| 2014/0072346 | A1 | 3/2014 | Furutani et al. |
| 2014/0072347 | A1 | 3/2014 | Furutani et al. |
| 2014/0079432 | A1 | 3/2014 | Matsuzaki et al. |
| 2014/0086620 | A1 | 3/2014 | Takeuchi et al. |
| 2014/0086621 | A1 | 3/2014 | Makiguchi et al. |
| 2014/0093272 | A1 | 4/2014 | Matsumaru et al. |
| 2014/0105639 | A1 | 4/2014 | Kikuchi et al. |
| 2014/0112685 | A1 | 4/2014 | Kolmatsu et al. |
| 2014/0126928 | A1 | 5/2014 | Batori et al. |
| 2014/0199092 | A1 | 7/2014 | Matsushita et al. |
| 2014/0199093 | A1 | 7/2014 | Yoshida et al. |
| 2014/0199094 | A1 | 7/2014 | Matsuzaki et al. |
| 2014/0199096 | A1 | 7/2014 | Yoshida et al. |
| 2014/0212166 | A1 | 7/2014 | Takeuchi et al. |
| 2014/0212181 | A1 | 7/2014 | Nakamura et al. |
| 2014/0270845 | A1 | 9/2014 | Kawakami et al. |
| 2014/0348535 | A1 | 11/2014 | Murakami et al. |
| 2014/0356020 | A1 | 12/2014 | Murakami et al. |
| 2014/0363196 | A1 | 12/2014 | Wada et al. |
| 2014/0376955 | A1 | 12/2014 | Takeuchi |
| 2014/0376969 | A1 | 12/2014 | Batori |
| 2015/0003865 | A1 | 1/2015 | Batori et al. |
| 2015/0010320 | A1 | 1/2015 | Komatsu et al. |

FOREIGN PATENT DOCUMENTS

| | | | |
|---|---|---|---|
| JP | H04-66980 | A | 3/1992 |
| JP | 2001-194907 | A | 7/2001 |
| JP | 2007-163925 | A | 6/2007 |
| JP | 2012-053422 | A | 3/2012 |
| WO | 2005/121907 | A1 | 12/2005 |

OTHER PUBLICATIONS

Jul. 26, 2016 Office Action in Japanese Patent Application No. 2013-122573.

* cited by examiner (a)

(b)

(a)

(b)

DEVELOPING CARTRIDGE, PROCESS CARTRIDGE AND IMAGE FORMING APPARATUS

TECHNICAL FIELD

The present invention relates to a developing cartridge and an image forming apparatus using the developing cartridge.

A device for visualizing an electrostatic latent image, with a developer, formed on a surface of a photosensitive drum as an image bearing member is a developing device. Here, the developing cartridge is prepared by integrally assembling the developing device into a cartridge, and is to be detachably mounted into a main assembly of the image forming apparatus.

Further, the process cartridge is prepared by integrally assembling the photosensitive drum and the developing device actable on the photosensitive drum into a cartridge, and is to be detachably mounted in the image forming apparatus main assembly. Further, the image forming apparatus forms an image on a recording material (medium) such as a sheet material by using, e.g., an electrophotographic image forming type.

Examples of the image forming apparatus may include an electrophotographic copying machine; an electrophotographic printer such as an LED (light emitting diode) printer or a laser beam printer; a facsimile machine; a word processor; and the like.

BACKGROUND ART

In a conventional image forming apparatus using an electrophotographic image forming process, a process cartridge type in which the photosensitive drum and a process means actable on the photosensitive drum are integrally assembled into a cartridge and this cartridge is made detachably mountable to the image forming apparatus main assembly is employed. In the developing device used in such a process cartridge, in a toner chamber for accommodating a developer (hereinafter referred to as a toner), the toner is directly accommodated.

Further, against a problem such that the toner is scattered in the process cartridge in a developer filling step during manufacturing of the process cartridge, Japanese Laid-Open Patent Application (JP-A) Hei 4-66980 proposes that a deformable inside container in which the toner is confined (hereinafter referred to as a "toner bag" is accommodated in a toner chamber.

However, in JP-A Hei 4-66980, a toner discharging operation after unsealing of the inside container was not taken into consideration. For example, in a constitution in which the bottom of the toner bag is not provided with inclination enough to permit fall (drop) of the toner by its own weight, it was difficult to discharge the toner in some cases. Further, also in a constitution in which an opening for the toner bag cannot be formed in a lower side with respect to a direction of gravitation, there is the case where it is different to discharge the toner.

SUMMARY OF THE INVENTION

A principal object of the present invention is to provide a developing cartridge capable of solving the above-described problems.

According to an aspect of the present invention, there is provided a developing cartridge comprising: a flexible developer bag, provided with an opening and provided in a frame, for accommodating a developer; and an acting member contactable to the developer bag, wherein the developer bag is fixed to the frame at its upper portion, and wherein the developer bag is swingable by contact with the acting member.

These and other objects, features and advantages of the present invention will become more apparent upon a consideration of the following description of the preferred embodiments of the present invention taken in conjunction with the accompanying drawings.

Figure 9:
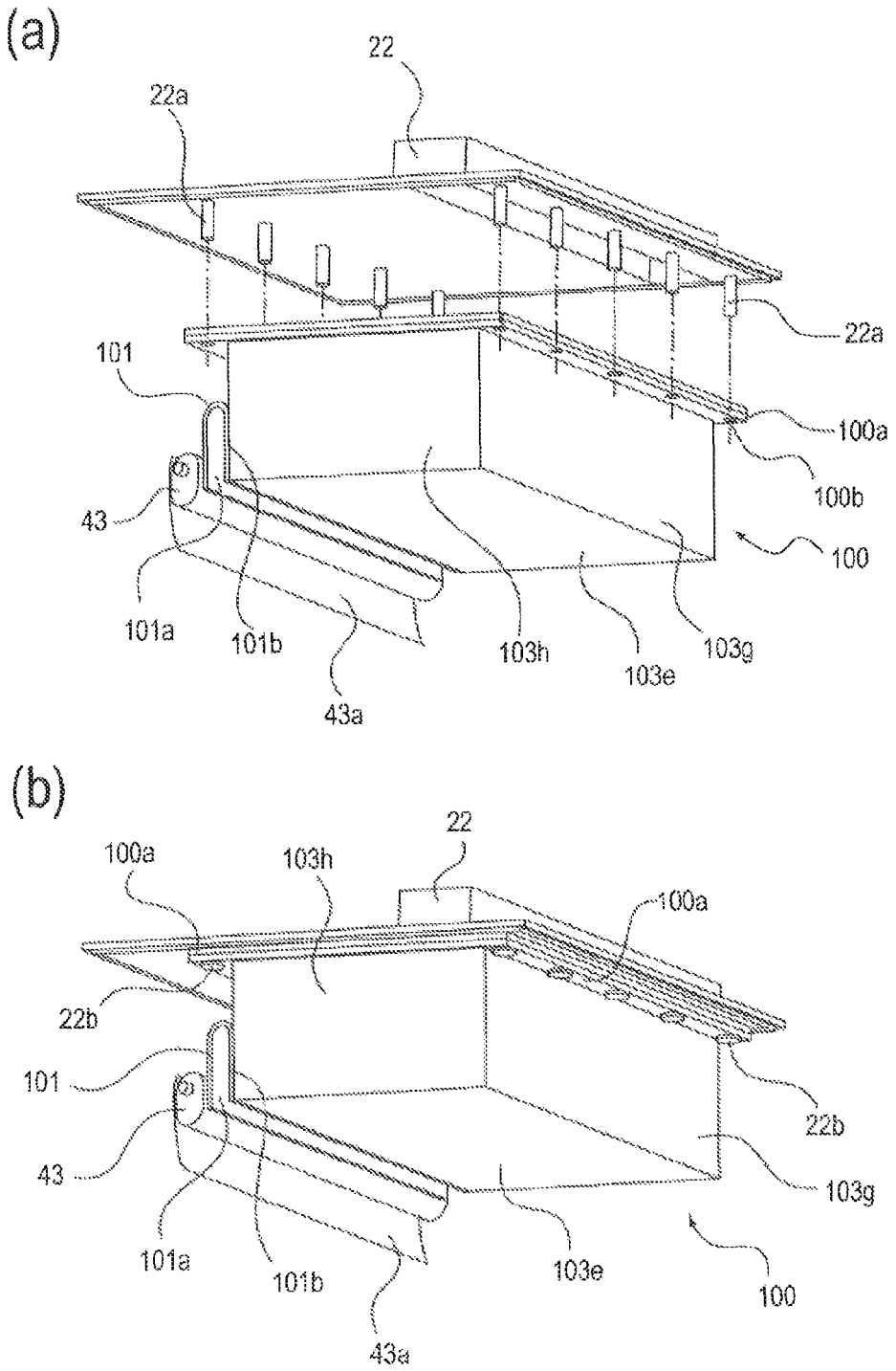

Parts (a) and (b) of FIG. 9 are perspective views for illustrating a constitution in which the developer bag is fixed to a frame at an upper portion of the developer bag in Embodiment 1.

Figure 10:
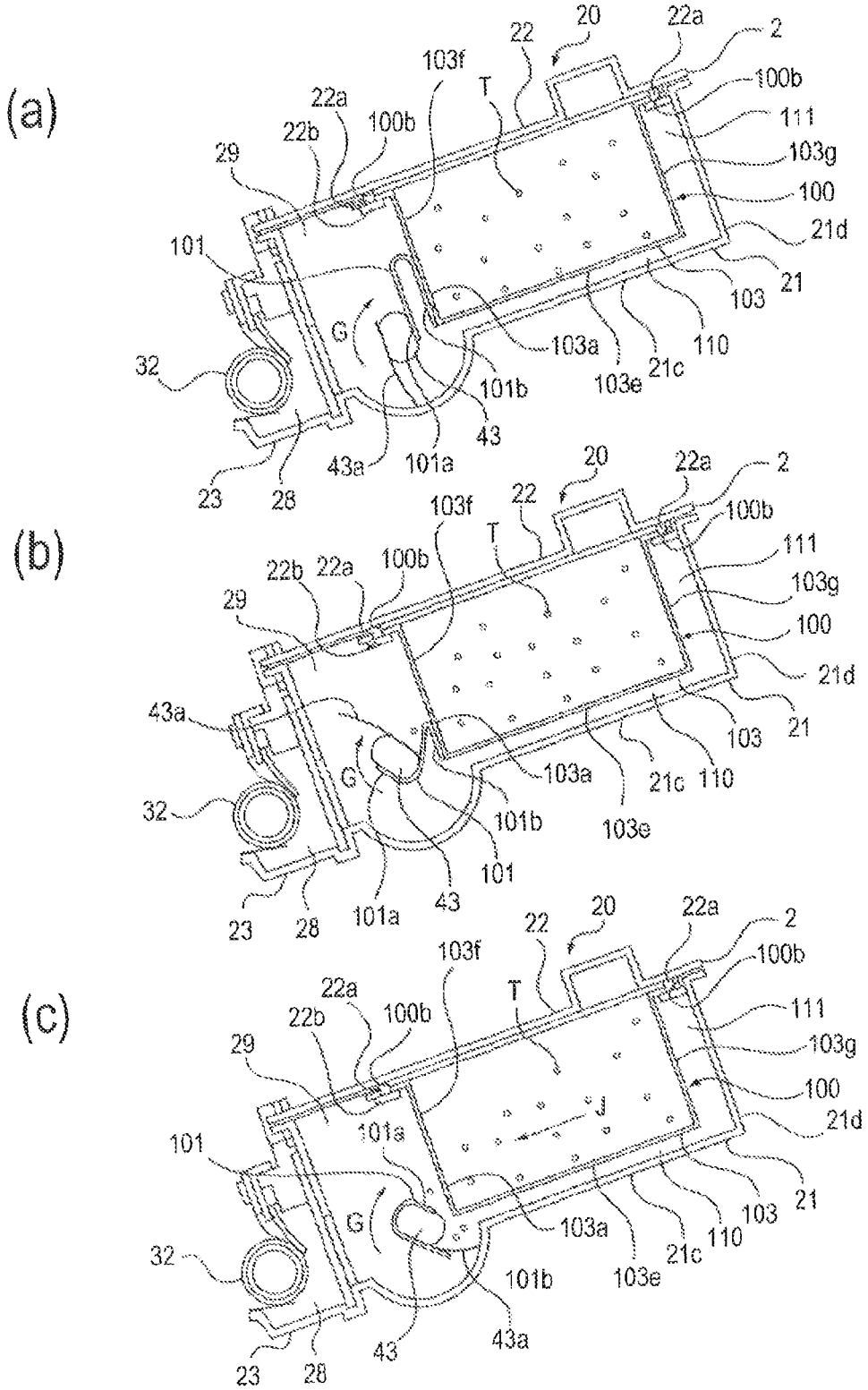

Parts (a) to (c) of FIG. 10 are sectional illustrations showing a state in which an opening of the developer bag in Embodiment 1 is unsealed.

Figure 11:
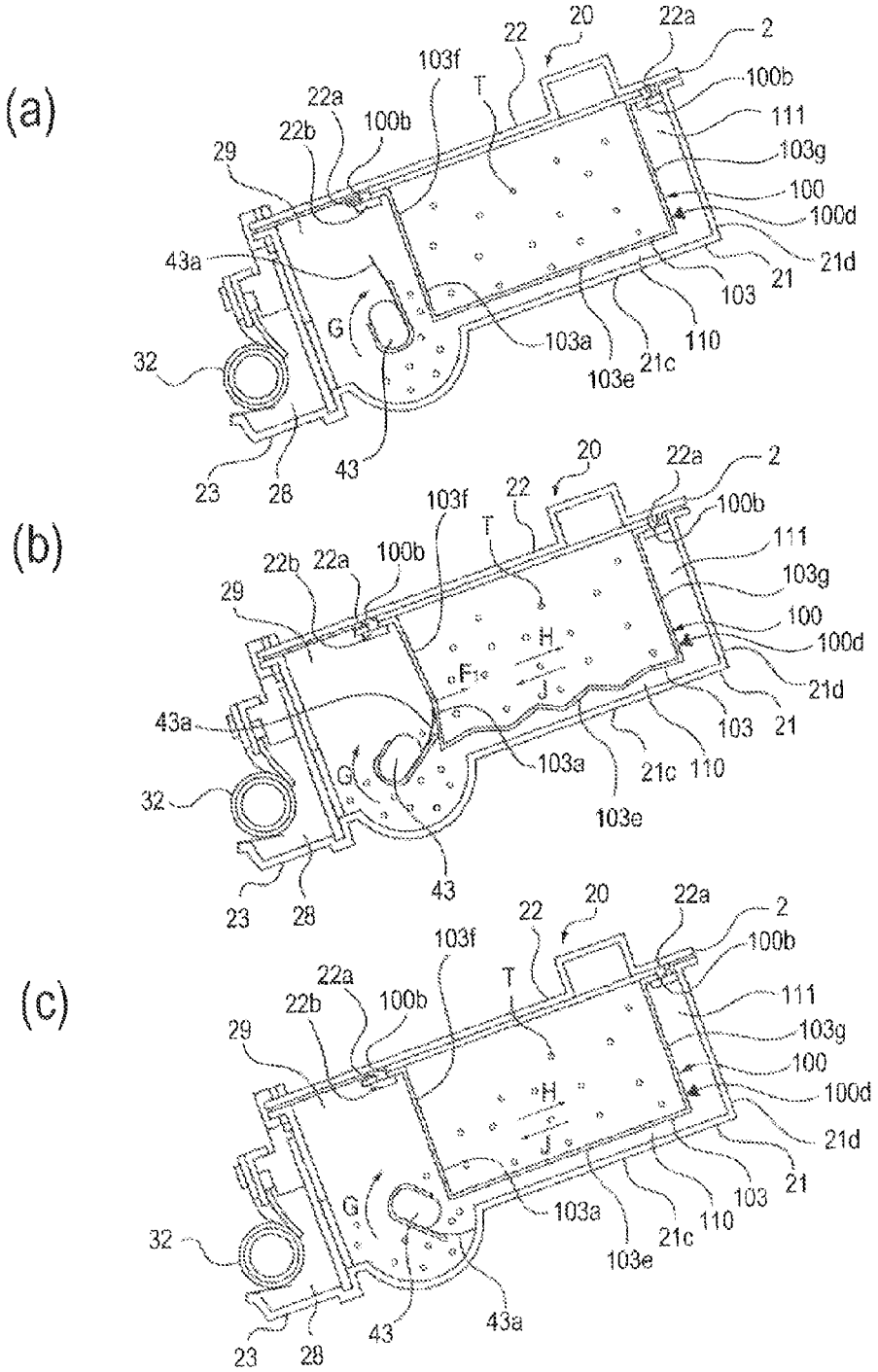

Parts (a) to (c) of FIG. 11 are sectional illustrations showing a state in which discharging of the developer is urged by swinging the developer bag by periodical contact of an acting member with the developer bag in Embodiment 1.

Figure 12:
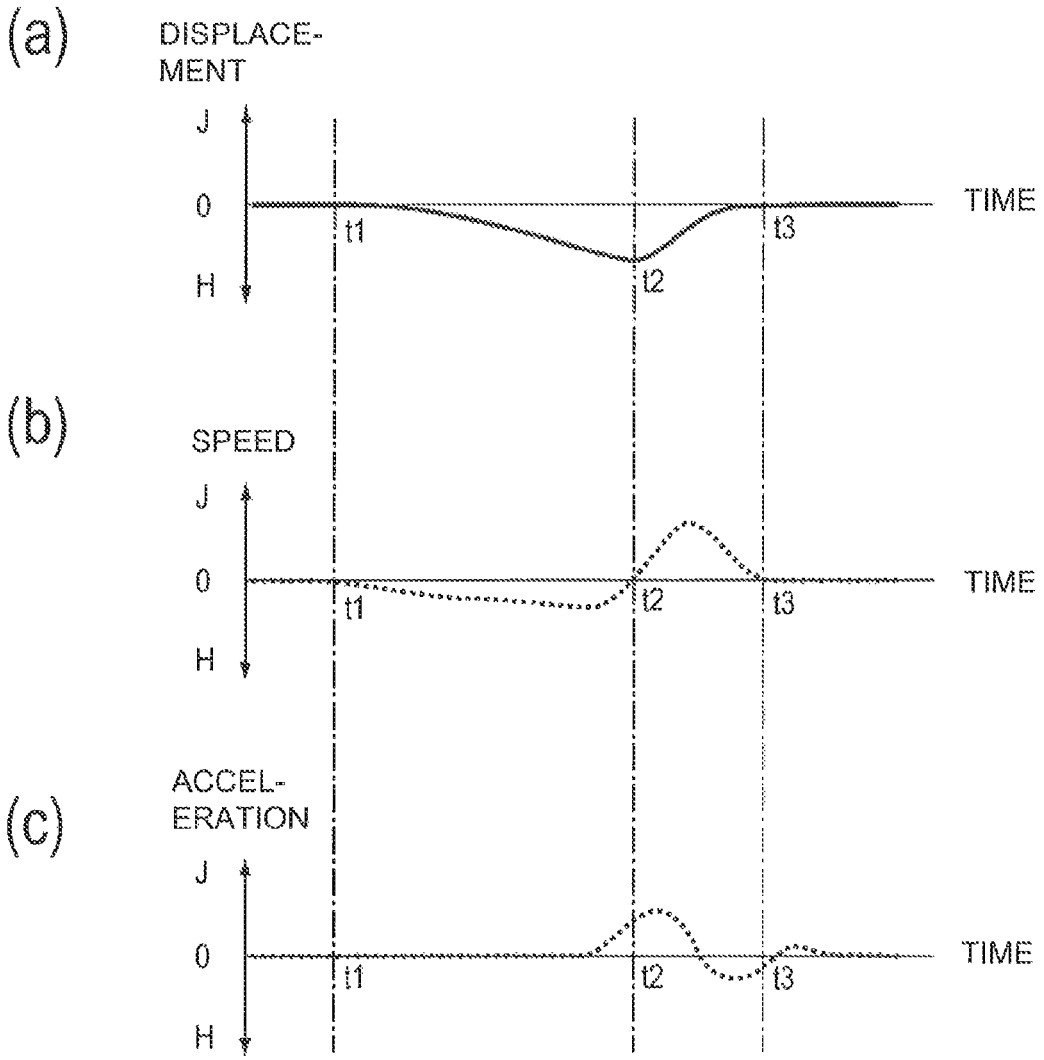

Parts (a) to (c) of FIG. 12 are time charts showing results of an experiment in which a displacement, a speed and an acceleration, respectively are measured with respect to a behavior of the developer in the developer bag when the developer bag is swung by the periodical contact of the acting member with the developer bag in Embodiment 1.

Figure 13:
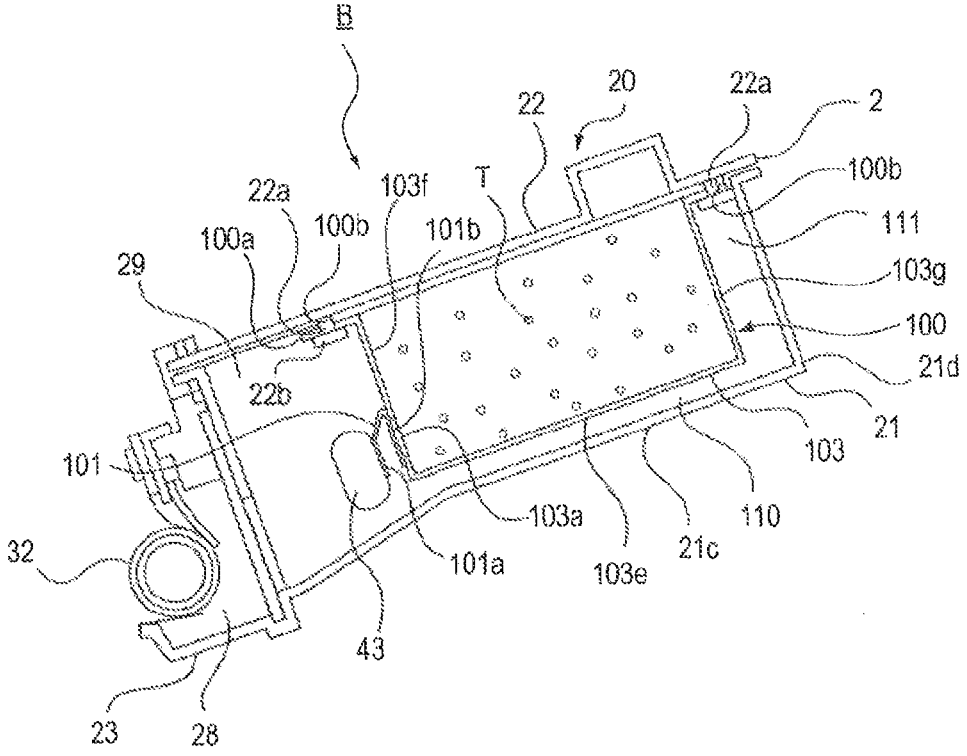

FIG. 13 is a sectional illustration showing a structure of a process cartridge also functioning as a developing cartridge according to the present invention in Embodiment 2.

Figure 14:
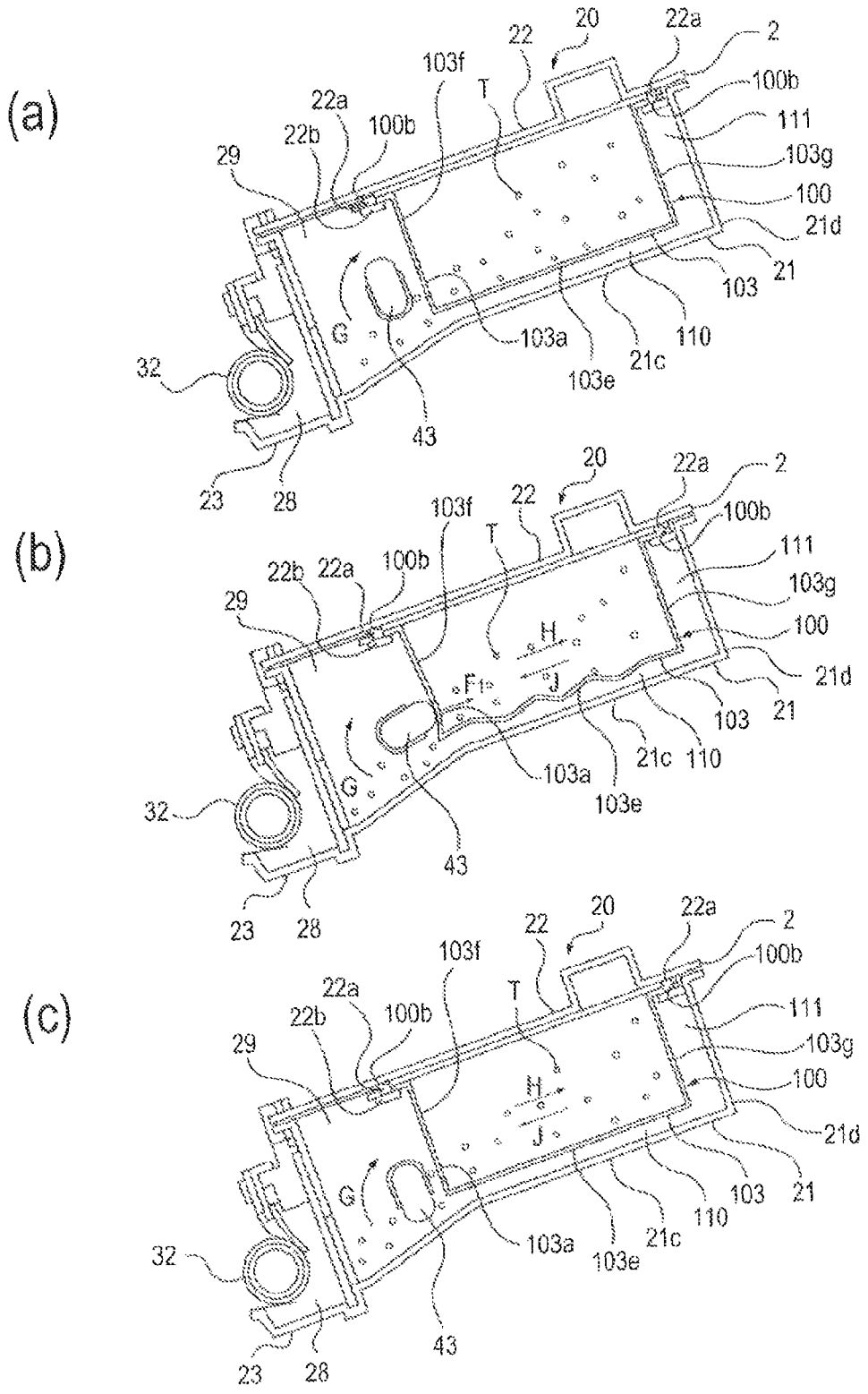

Parts (a) to (c) of FIG. 14 are sectional illustrations showing a state in which discharging of the developer is urged by swinging the developer bag by periodical contact of an acting member with the developer bag in Embodiment 2.

Figure 15:
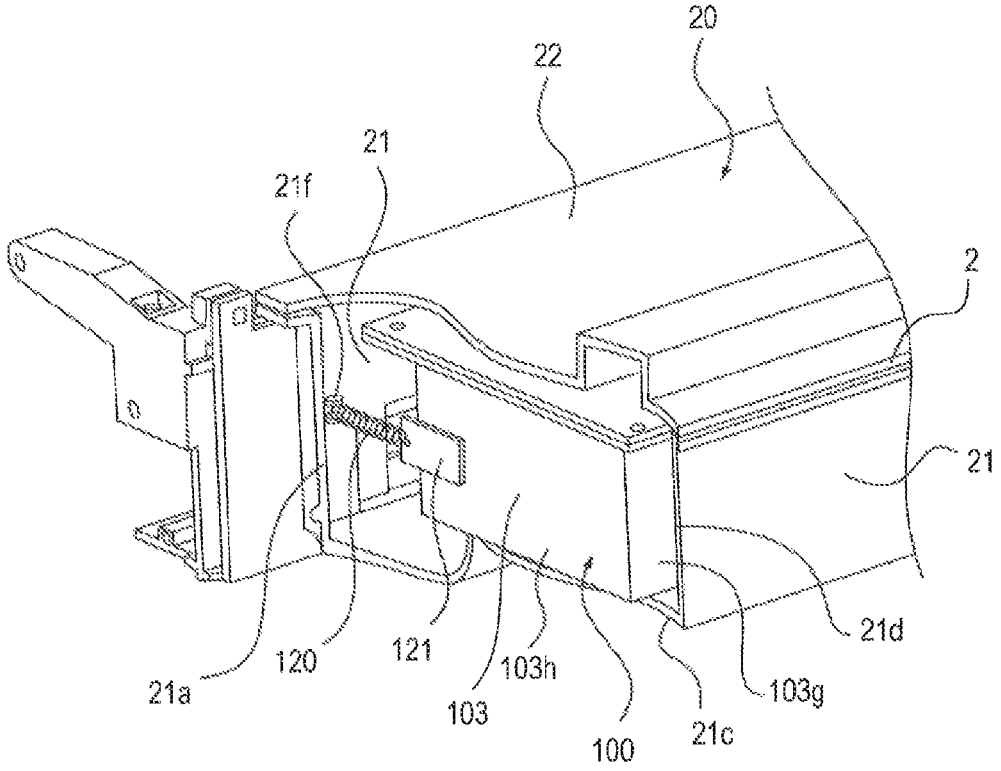

FIG. 15 is a perspective illustration showing a structure of a process cartridge also functioning as a developing cartridge according to the present invention in Embodiment 3.

Figure 16:
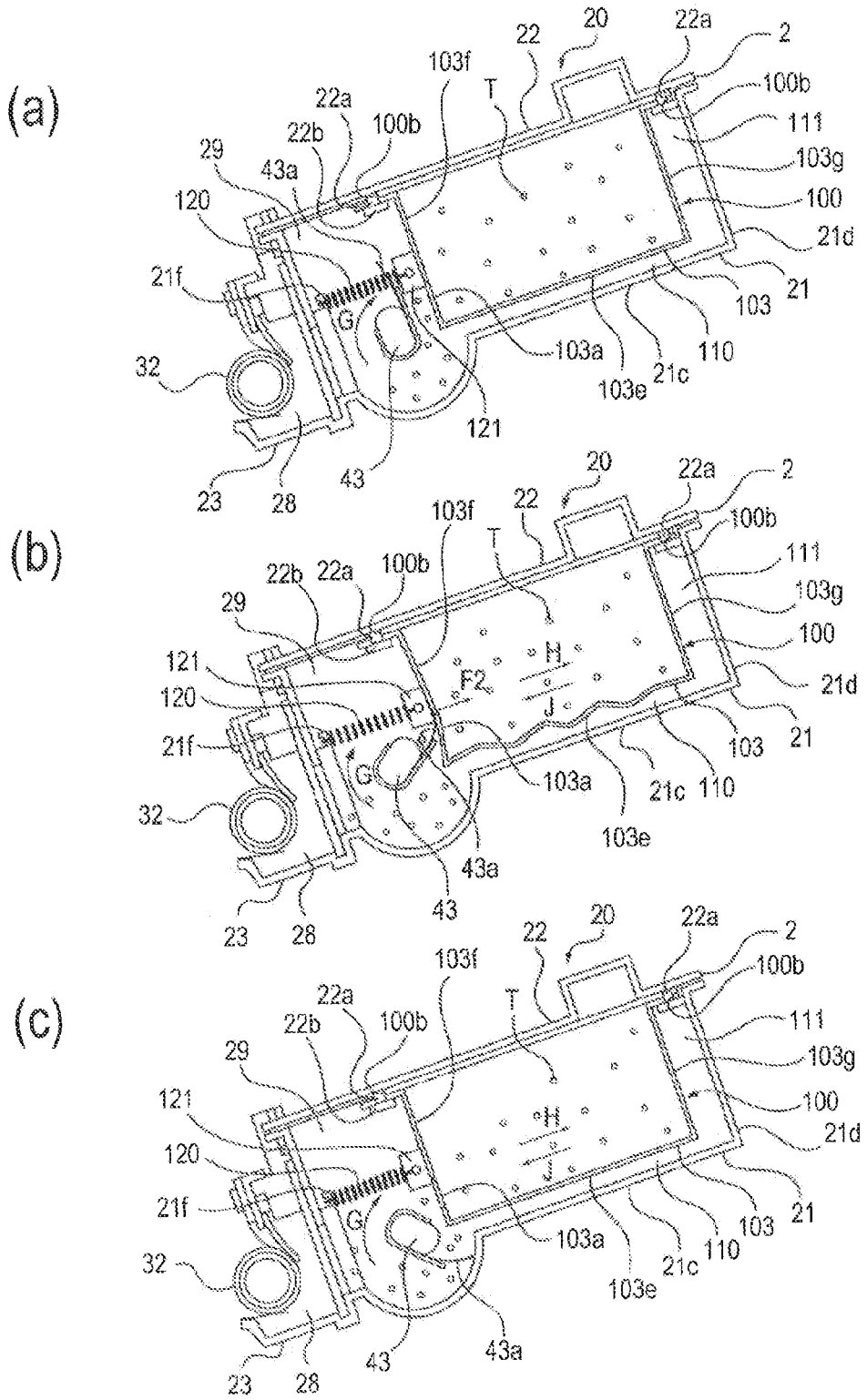

Parts (a) to (c) of FIG. 16 are sectional illustrations showing a state in which discharging of the developer is urged by swinging the developer bag by periodical contact of an acting member with the developer bag in Embodiment 3.

Figure 17:
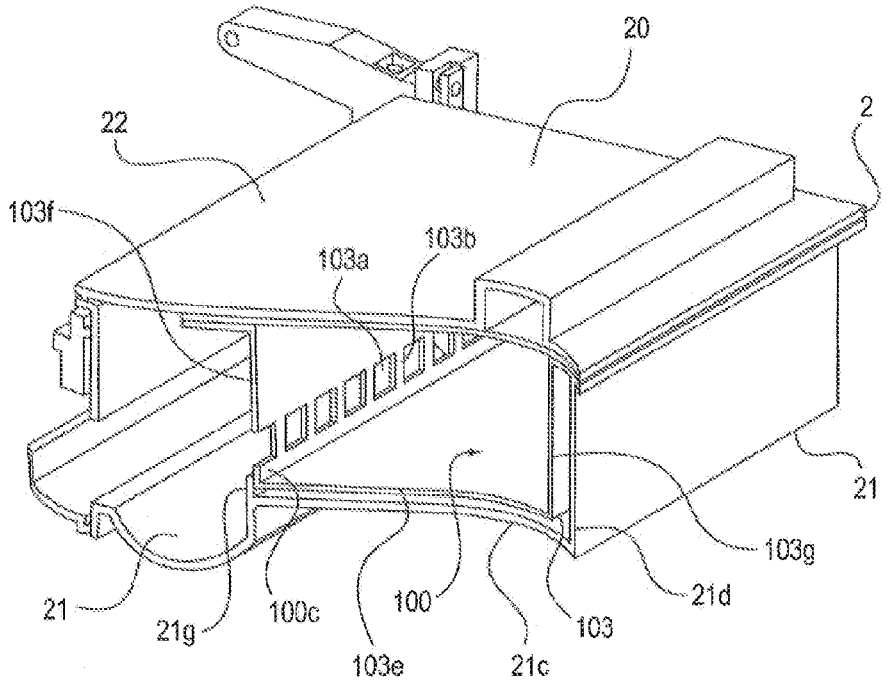

FIG. 17 is a perspective illustration showing a structure of a process cartridge also functioning as a developing cartridge according to the present invention in Embodiment 4.

Figure 18:
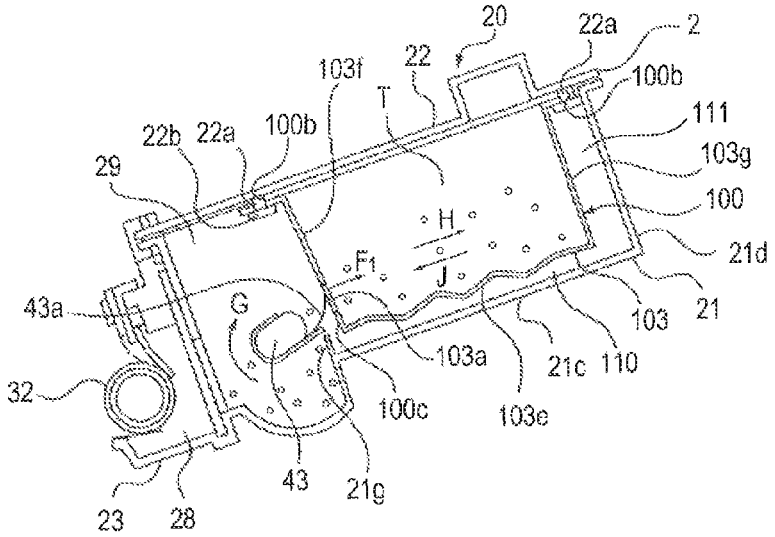
Figure 18:
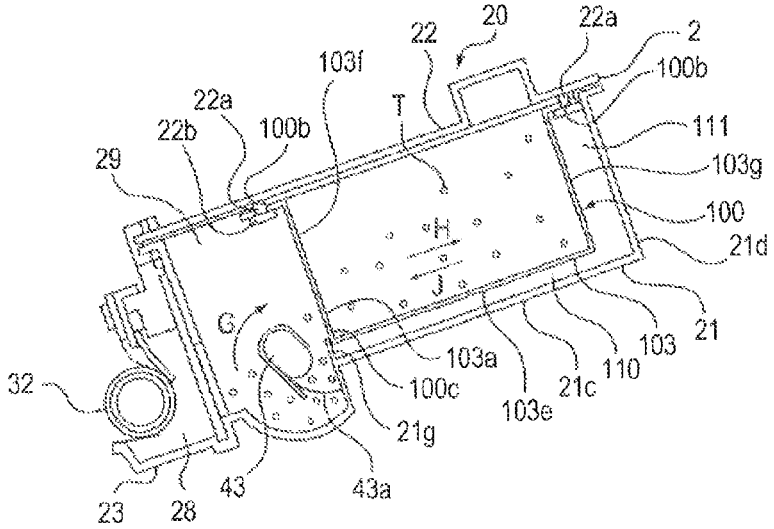

Parts (a) and (b) of FIG. 18 are sectional illustrations showing a state in which discharging of the developer is urged by swinging the developer bag by periodical contact of an acting member with the developer bag in Embodiment 4.

Figure 19:
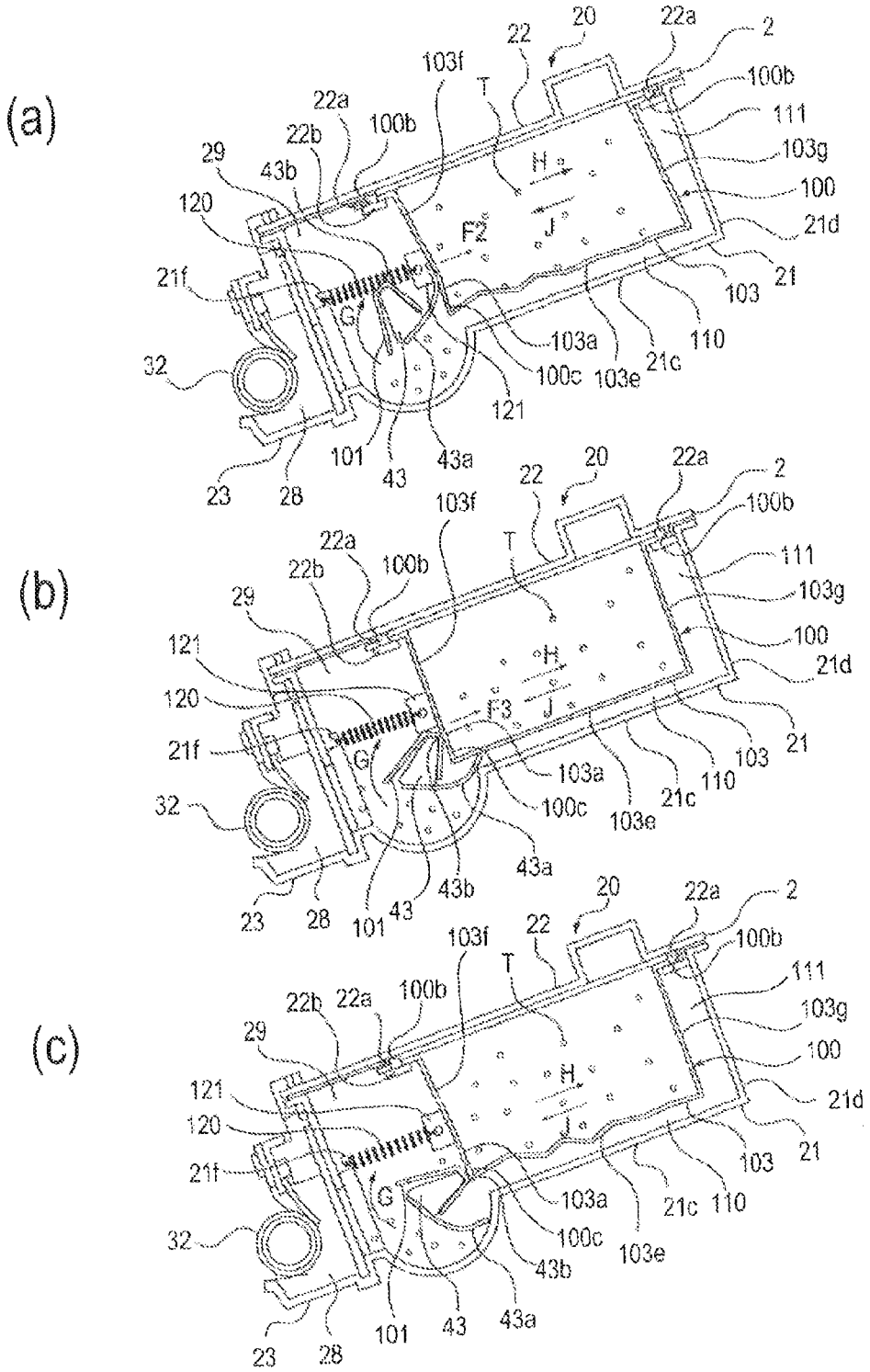

Parts (a) to (c) of FIG. 19 are sectional illustrations showing a state in which discharging of the developer is urged by swinging a developer bag by periodically contact of an acting member with the developer bag of a process cartridge also functioning as a developing cartridge according to the present invention in Embodiment 5.

Figure 20:
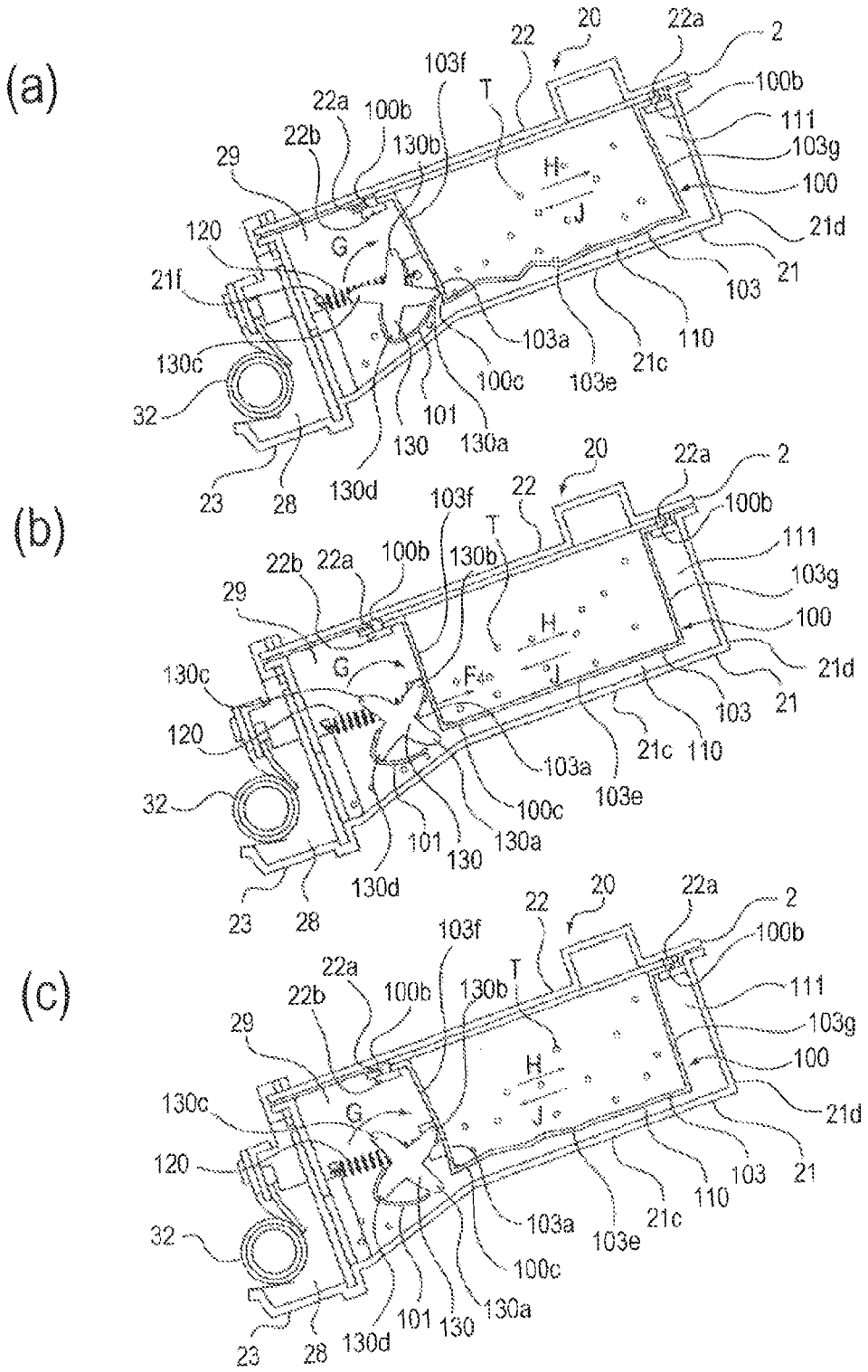

Parts (a) to (c) of FIG. 20 are sectional illustrations showing a state in which discharging of the developer is urged by swinging a developer bag by periodically contact of an acting member with the developer bag of a process cartridge also functioning as a developing cartridge according to the present invention in Embodiment 6.

Figure 21:
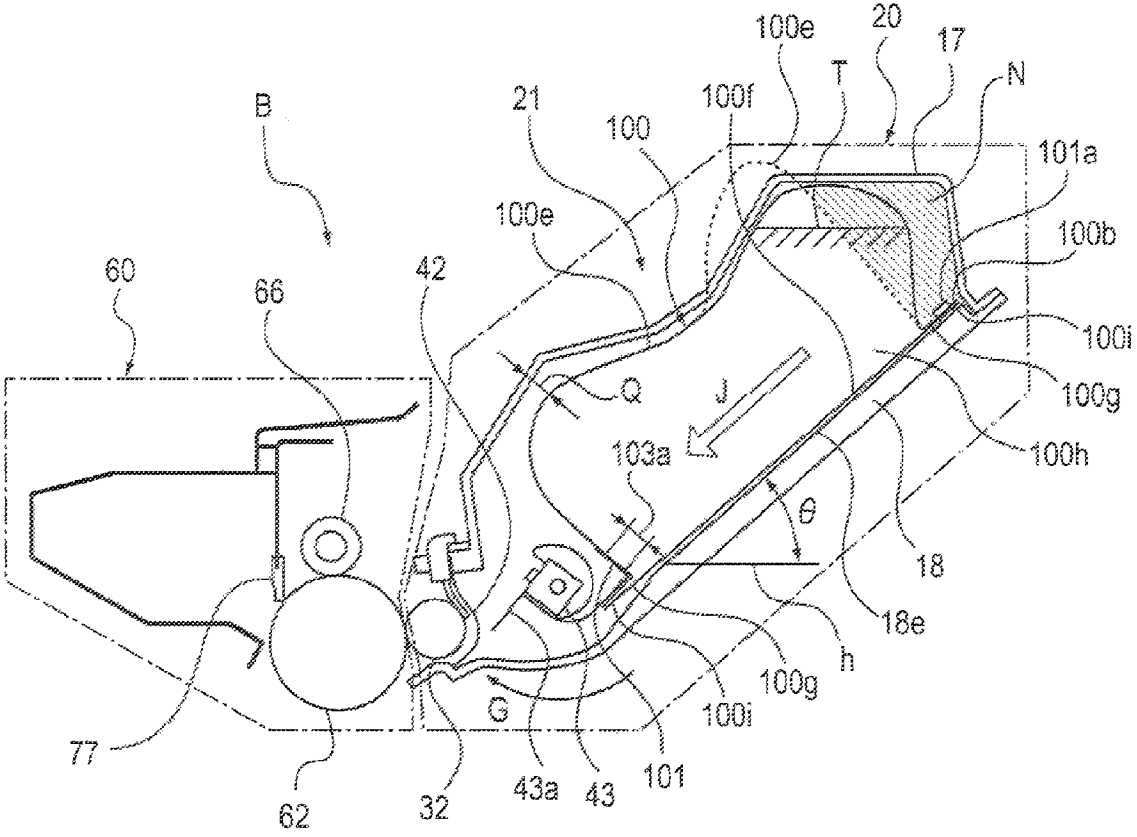

FIG. 21 is a sectional illustration showing a structure of a process cartridge also functioning as a developing cartridge according to the present invention in Embodiment 7.

Figure 22:
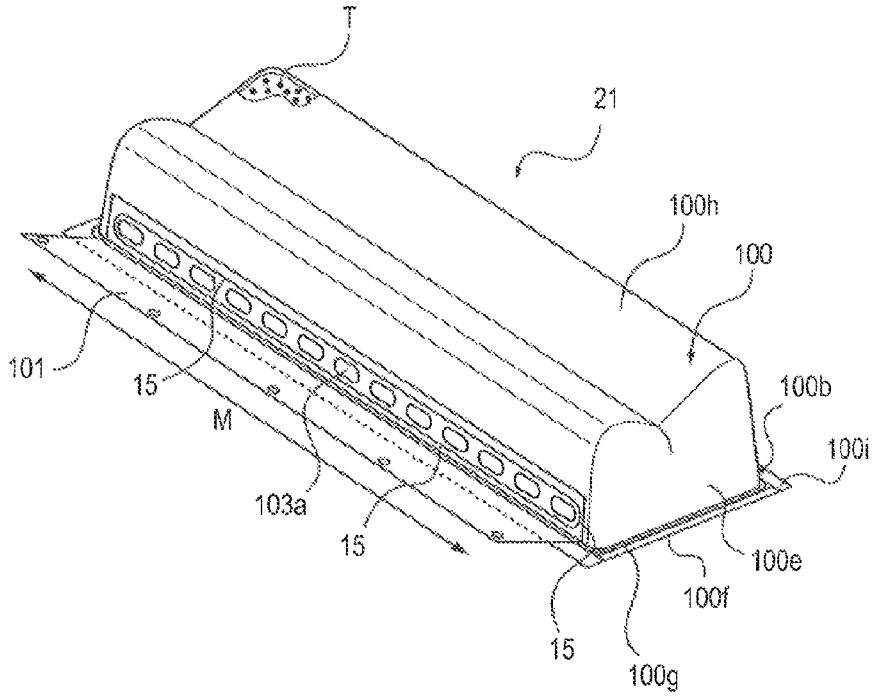
Figure 22:
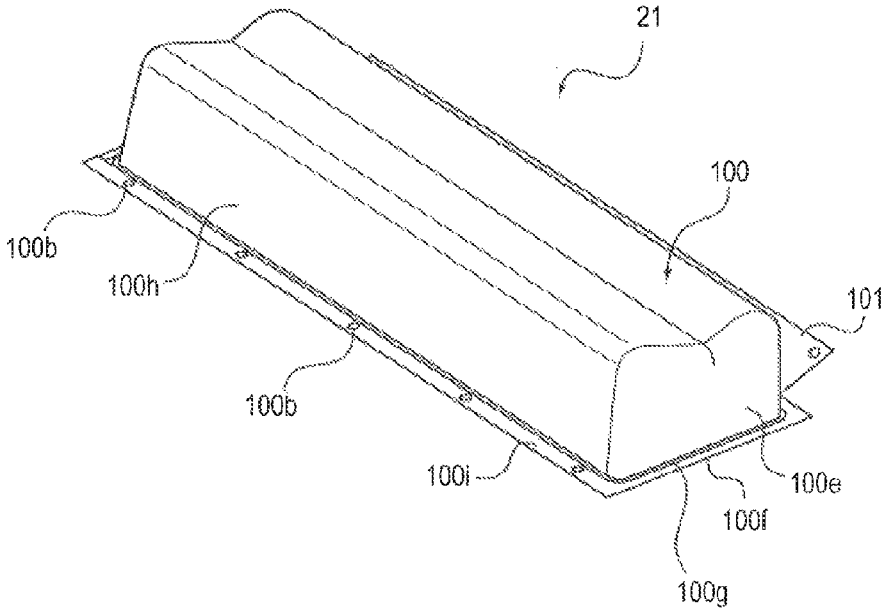

Parts (a) and (b) of FIG. 22 are perspective illustrations showing a structure of a developer bag in Embodiment 7.

DESCRIPTION OF EMBODIMENTS

With reference to the drawings, an embodiment of a developing cartridge according to the present invention, a process cartridge and an image forming apparatus in which the process cartridge is detachably mounted will be described specifically.

Embodiment 1

First, a structure of the developing cartridge according to the present invention, the process cartridge and the image forming apparatus in which the process cartridge is detachably mounted in this embodiment will be described with reference to FIGS. 1 to 12. Incidentally, in the following description, as shown in FIG. 4, a rotational axis direction (left-right direction in FIG. 4) of a photosensitive drum 62 as an image bearing member for forming an electrostatic latent image on a surface of the photosensitive drum 62 is referred to as a longitudinal of the photosensitive drum 62.

Figure 4:
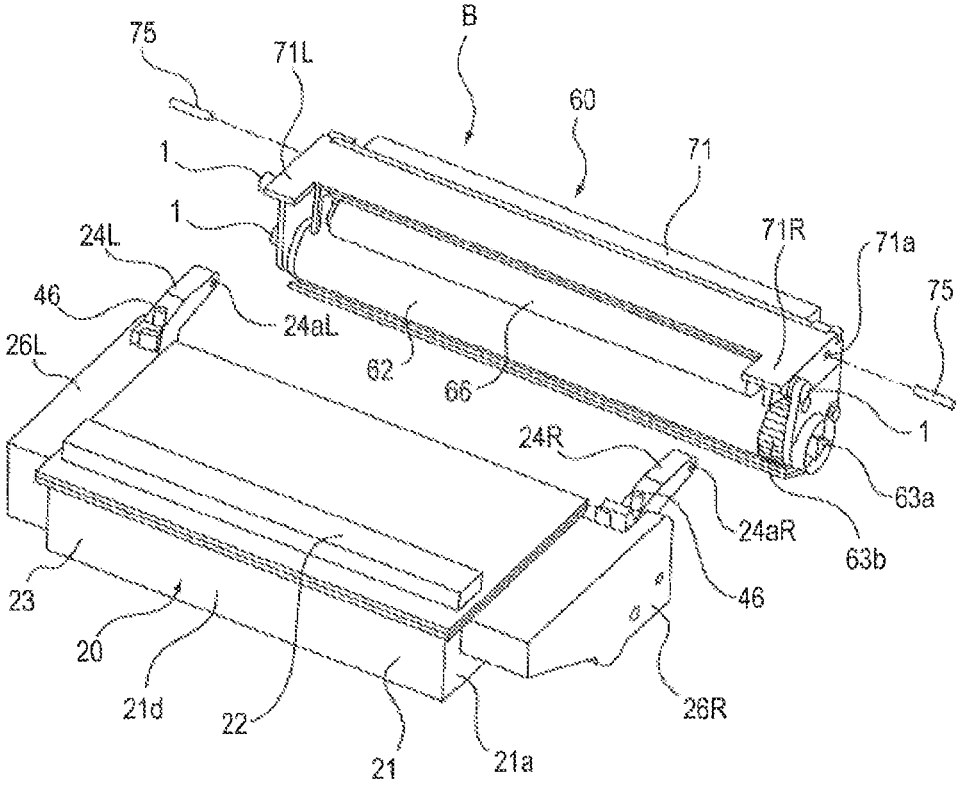
FIG. 4 is an exploded perspective view showing the structure of the process cartridge also functioning as the developing cartridge in Embodiment 1.

Further, with respect to the longitudinal direction of the photosensitive drum 62 shown in FIG. 4, a side (right side in FIG. 4) in which a driving force-receiving portion 63*a* where the photosensitive drum 62 receives a driving force from a main assembly of an image forming apparatus A is provided is referred to as a driving side, and its opposite side is referred to as a non-driving side.

<General Structure of Image Forming Apparatus and Image Forming Process Operation>

Figure 1:
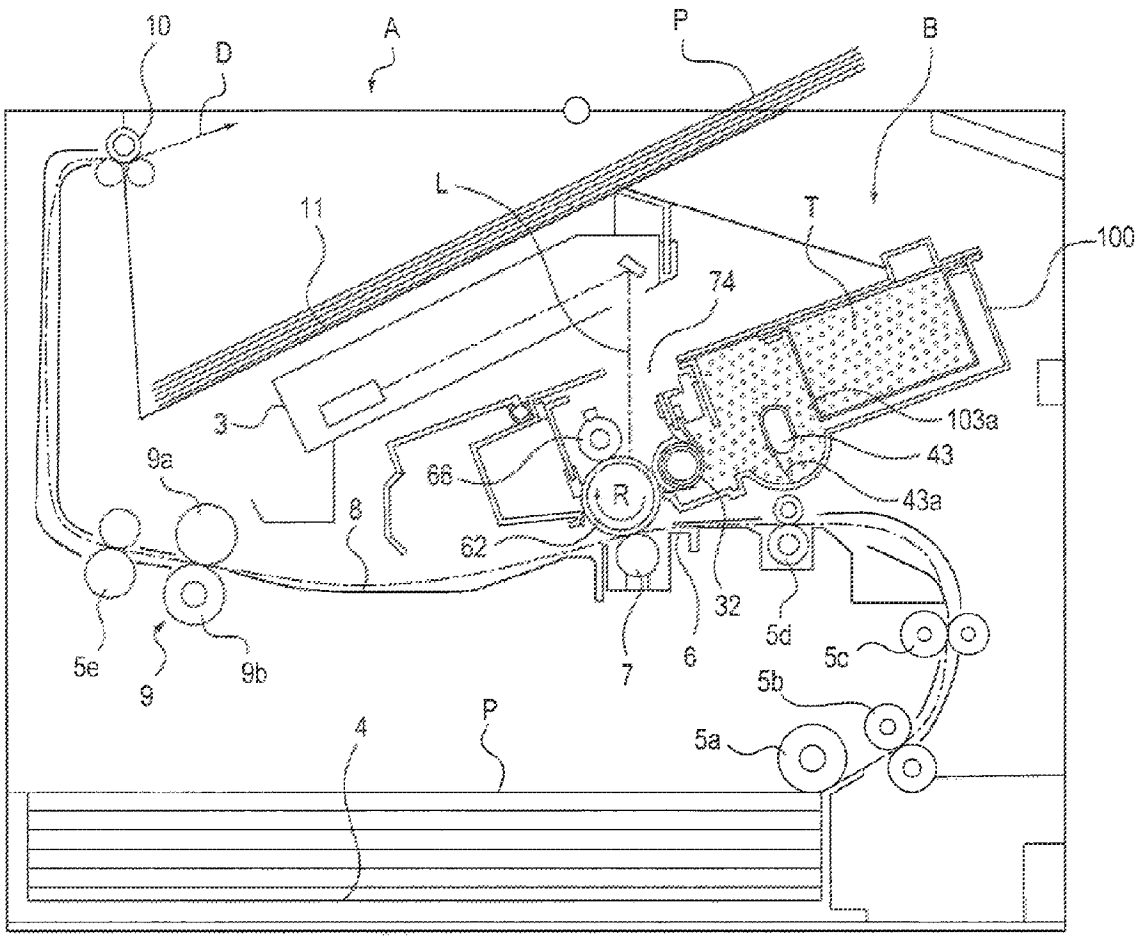
FIG. 1 is a sectional illustration showing a structure of an image forming apparatus in which a process cartridge also functioning as a developing cartridge according to the present invention in Embodiment 1.

A general structure of the image forming apparatus A and an image forming process operation will be described with reference to FIGS. 1 and 3. FIG. 1 is a sectional illustration showing a state in which a process cartridge B also functioning as the developing cartridge is detachably mounted in the main assembly of the image forming apparatus A of an electrophotographic type as an example of this embodiment.

Figure 3:
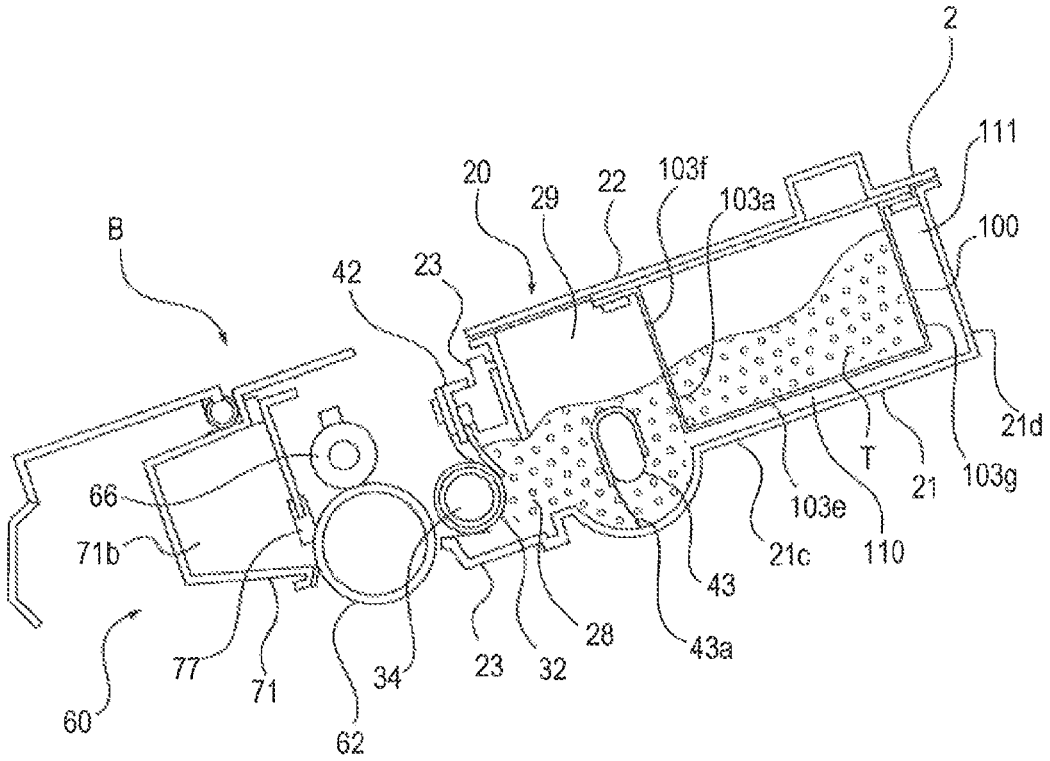
FIG. 3 is a sectional illustration showing a structure of the process cartridge also functioning as the developing cartridge in Embodiment 1.

FIG. 3 is a sectional illustration showing a structure of the process cartridge B. Here, the main assembly of the image forming apparatus A refers to a portion of the image forming apparatus A from which the process cartridge B is removed.

<General Structure of Image Forming Apparatus>

Next, the general structure of the image forming apparatus A will be described with reference to FIGS. 1 and 3. The image forming apparatus A shown in FIG. 1 is a laser beam printer, using an electrophotographic type, in which the process cartridge B is detachably mountable to the main assembly of the image forming apparatus A. When the process cartridge B is mounted in the main assembly of the image forming apparatus A, above the process cartridge B in FIG. 1, a laser scanner unit as an exposure device is provided.

Further, below the process cartridge B in FIG. 1, a (sheet) feeding tray 4 in which a recording material P to be subjected to image formation is accommodated is provided. Further, in the main assembly of the image forming apparatus A, along a conveyance direction of the recording material S indicated by an arrow D in FIG. 1, a pick-up roller 5*a*, a feeding roller 5*b*, a conveying roller 5*c* and a registration roller 5*d* are provided. Further, a transfer guide 6, a transfer roller 7, a conveying guide 8, a fixing device 9, a conveying roller 5*e*, a discharging roller 10, a discharge tray 11 and the like are successively provided. Incidentally, the fixing device 9 is constituted by including a heating roller 9*a* and a pressing roller 9*b*.

<Image Forming Process Operation>

Next, an image forming process operation will be described. On the basis of a print start signal, the photosensitive drum 62 is rotationally driven at a predetermined peripheral speed (process speed) in an arrow R direction in FIG. 1. A charging roller 66 as a charging means to which a charging bias voltage is applied from an unshown charging bias power source contacts the outer peripheral surface of the photosensitive drum 62 and electrically charges the outer peripheral surface of the photosensitive drum 62 uniformly.

The laser scanner unit 3 outputs laser light L depending on image information. The laser light L passes through an exposure window portion 74 provided at an upper surface of the process cartridge B, so that the outer peripheral surface of the photosensitive drum 62 is subjected to scanning exposure. As a result, on the outer peripheral surface of the photosensitive drum 62, an electrostatic latent image depending on the image information is formed.

On the other hand, as shown in FIG. 3, in a developing unit 20 as the developing device, a toner T as the developer in a toner chamber 29 is fed to a toner feeding chamber 28 communicating with the toner chamber 29 by rotation of a feeding member 43. On the feeding member 43, an end portion of a sheet member 43*a* is fixed. The sheet member 43*a* is an acting member (actable member) which periodically contacts a flexible developer bag 100 which is provided inside a frame constituted by a cap member 22 and a toner accommodating container 21 and which accommodates the toner T.

Figure 6:
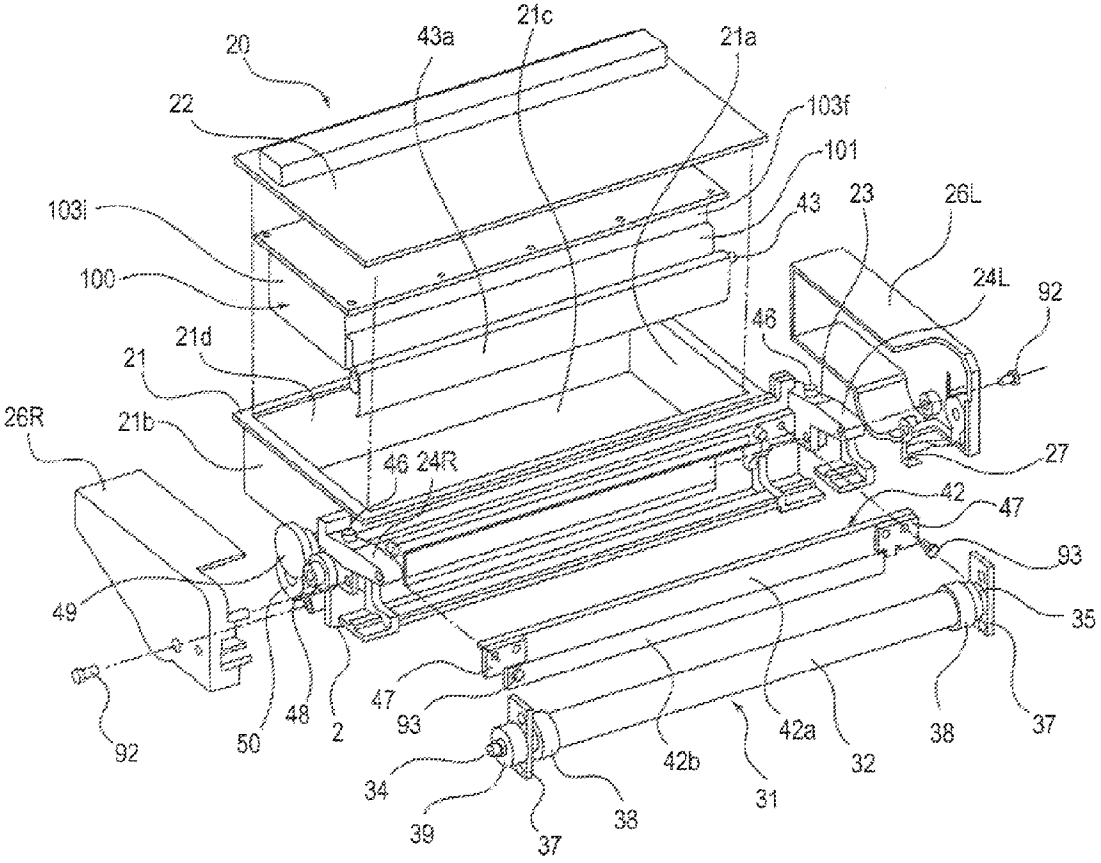
FIG. 6 is an exploded perspective view showing a developing unit in Embodiment 1.

The feeding member 43 on which the end portion of the sheet member 43*a* is fixed is rotationally driven by an unshown driving source such as a motor. The feeding member 43 is, as shown in FIG. 6, constituted in an elongated almost rectangular shape in cross section along a longitudinal direction of the developing unit 20, and on its outer peripheral surface, the sheet member 43*a* as the acting member is fixed. Then, by the rotational drive of the feeding member 43, the sheet member 43*a* as the acting member is rotated integrally with the feeding member 43. The sheet member 43*a* also functions as a feeding member for feeding the toner T in the process cartridge B also functioning as the developing cartridge.

The sheet member 43*a* is formed in a flexible sheet shape. The sheet member 43*a* is constituted by a material such as polyphenylene sulfide (PPS), polycarbonate (PC) or polyethylene terephthalate (PET). By the integral rotation of the sheet member 43*a* with the feeding member 43, stirring of the toner T in the toner chamber 29 and feeding of the toner T into the toner feeding chamber 28 are effected.

The toner T fed into the toner feeding chamber 28 is carried on a surface of a developing roller 32 as a developing means by a magnetic force of a magnet roller 34 formed with a fixed magnet. The toner T is deposited on the surface of the developing roller 32 while being triboelectrically charged and regulated in a predetermined layer thickness by a developing blade 42. The toner T deposited on the developing roller 32 is transferred depending on the electrostatic latent image formed on the surface of the photosensitive drum 62, so that the electrostatic latent image is visualized as a toner image.

Further, as shown in FIG. 1, in synchronism with output timing of the laser light L, by the pick-up roller 5*a*, sheets of the recording material P accommodated in the feeding tray 4 provided at a lower portion of the main assembly of the image forming apparatus A shown in FIG. 1 are separated and fed one by one.

Further, the recording material P is conveyed to the registration roller 5*d* by the feeding roller 5*b* and the conveying roller 5*c*. Then, by the registration roller 5*d*, the recording material P is conveyed, in synchronism with the toner image formed on the surface of the photosensitive drum 62, to a transfer position as a nip between the photosensitive drum 62 and the transfer roller 7 as a transfer means via the transfer guide 6.

In this transfer position, a transfer bias voltage is applied from an unshown transfer bias power source to the transfer roller 7, so that the toner image formed on the surface of the photosensitive drum 62 is successively transferred onto the recording material P. The recording material S on which the toner image is transferred is separated from the photosensitive drum 62 and then is conveyed to the fixing device 9 along the conveying guide 8. Then, the recording material P passes through a fixing nip between the heating roller 9*a* and the pressing roller 9*b* which constitute the fixing device 9. In this way, the image forming apparatus A forms the image on the recording material by using the toner T as the developer.

The unfixed toner image transferred on the surface of the recording material P is heated and pressed at the fixing nip, so that the toner image is fixed on the recording material P. The recording material P on which the toner image is fixed is conveyed to the discharging roller 10 by the conveying roller 5*e* and then is discharged onto the discharge tray 11.

On the other hand, as shown in FIG. 3, the surface of the photosensitive drum 62 after the toner image is transferred onto the recording material P is, from which a residual toner is removed by a cleaning blade 77 as a cleaning means, used again in the image forming process. The residual (waste) toner removed from the photosensitive drum 62 is stored in a residual toner chamber 71*b* of a cleaning unit 60.

The charging roller 66 as the charging means, the developing roller 32 as the developing means, the cleaning blade 77 as the cleaning means which are shown in FIG. 3 are the image forming process means actable on the photosensitive drum 62 as the image bearing member.

<Mounting and Demounting Operation of Process Cartridge>

Figure 2:
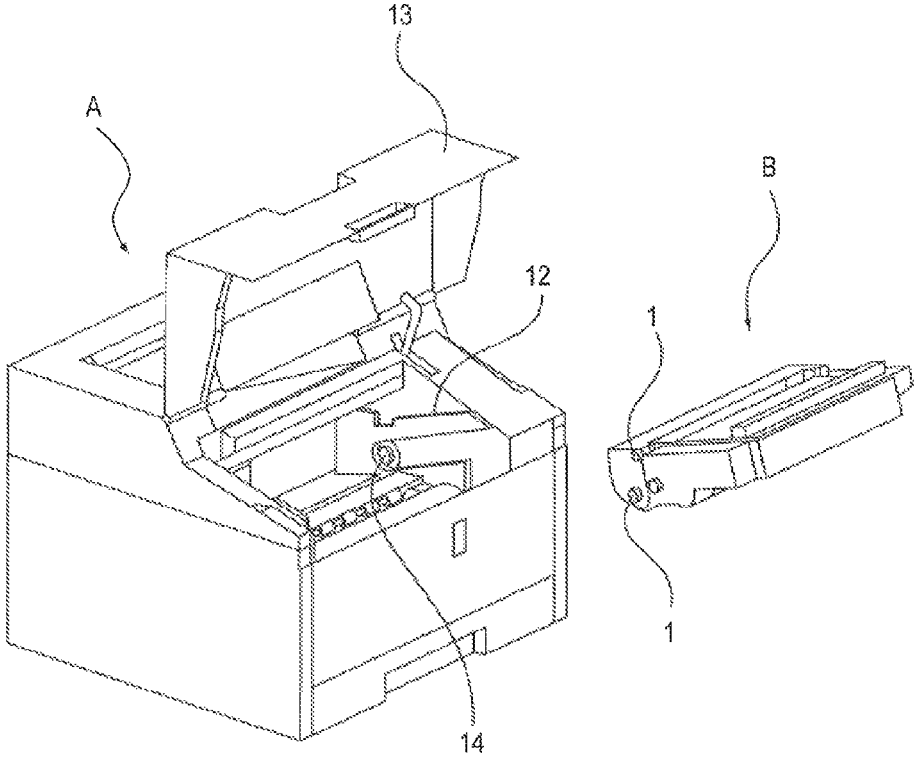
FIG. 2 is a perspective illustration showing a state in which the process cartridge also functioning as the developing cartridge according to the present invention is detachably mountable to a main assembly of the image forming apparatus.

Next, a mounting and demounting operation of the process cartridge B with respect to the main assembly of the image forming apparatus A will be described with reference to FIGS. 2 and 4. FIG. 2 is a perspective view showing the main assembly of the image forming apparatus A in which an openable door 13 is opened for mounting and demounting the process cartridge B, and showing the process cartridge B.

As shown in FIG. 2, the main assembly of the image forming apparatus A is provided with the openable door 13 in a rotatable and movable manner. Further, the main assembly of the image forming apparatus A is provided, on its left and right inner wall surfaces, with guide rails 12 with which projections 1 projected from the left and right side surfaces of the process cartridge B to be slidably engaged. Further, the openable door 13 is opened, and then the process cartridge B is mounted into the main assembly of the image forming apparatus A along the guide rails 12.

Then, a driving shaft 14 to be rotationally driven by an unshown motor as a driving source in the main assembly of the image forming apparatus A shown in FIG. 1 is engaged with a driving force receiving portion 63*a* provided on the process cartridge B shown in FIG. 4. As a result, the photosensitive drum 62 connected with the driving force receiving portion 63*a* is rotated by receiving the driving force from the main assembly of the image forming apparatus A. The charging roller 66 and the developing roller 32 are supplied with electric power (energy) from an unshown electric power supplying portion provided in the main assembly of the image forming apparatus A.

<General Structure of Process Cartridge>

Next, with respect to FIGS. 4 and 6, a general structure of the process cartridge B will be described. FIG. 4 is an exploded perspective view showing a structure of the process cartridge B. As shown in FIGS. 3 and 4, the process cartridge B in this embodiment is constituted by combining the cleaning unit 60 and the developing unit 20.

The cleaning unit 60 is constituted by including a cleaning frame 71, the photosensitive drum 62, the charging roller 66, the cleaning blade 77 and the like. On the other hand, the developing unit 20 includes a toner accommodating container 21 as a frame, a cap member 22 and a developing (member) container 23. Further, the developing unit 20 includes left and right side members 26L and 26R, a developing blade 42, the developing roller 32, the magnet roller 34, the feeding member 43, the developer bag 100, the toner T, an urging member 46, and the like.

At end portions of the developing container 23 of the developing unit 20 with respect to the longitudinal (left-right direction in FIG. 4), left and right arm portions 24L and 24R are provided. Further, the left and right arm portions 24L and 24R are provided, at their end portions, with through-holes 24*a*L and 24*a*R in parallel to the rotational axis direction of the developing roller 23. On the other hand, at each of wall surfaces of end portions of the cleaning unit 60 with respect to the longitudinal direction (left-right direction in FIG. 4), an engaging hole 71*a* is provided.

Then, the left and right arm portions 24L and 24R of the developing unit 20 are engaged with the end portions of the cleaning unit 60. Then, a pin-like connecting member 75 is inserted into each of the through-holes 24*a*L and 24*a*R of the left and right arm portions 24L and 24R of the developing unit 20 and is also inserted into the engaging hole 71*a* provided at each of the end portions of the cleaning unit 60. As a result, the cleaning unit 60 and the developing unit 20 are rotationally movably connected with each other by the connecting member 75, so that the process cartridge B is constituted.

At this time, at each of base portions of the left and right arm portions 24L and 24R of the developing unit 20, an end portion of the urging member 46 such as a coil spring is mounted. Another end portion of the urging member 46 is contact to each of the contact portions 71L and 74R provided at the end portions of the cleaning frame 71 of the cleaning unit 60 with respect to the longitudinal direction (left-right direction in FIG. 4) of the cleaning frame 71.

Further, the urging member 46 urges, by its elastic force, the developing roller 32 rotatably provided in the developing unit 20 about the connecting members 75 toward the photosensitive drum 62 rotatably provided in the cleaning unit 60.

As a result, the developing roller 32 is pressed through the photosensitive drum 62 with reliability. Then, by a gap (spacing) holding member 38 mounted at each of the end portions of the developing roller 32 with respect to the axial direction of the developing roller 32, the developing roller 32 is held with a predetermined gap from the photosensitive drum 62.

<Developing Unit>

Figure 7:
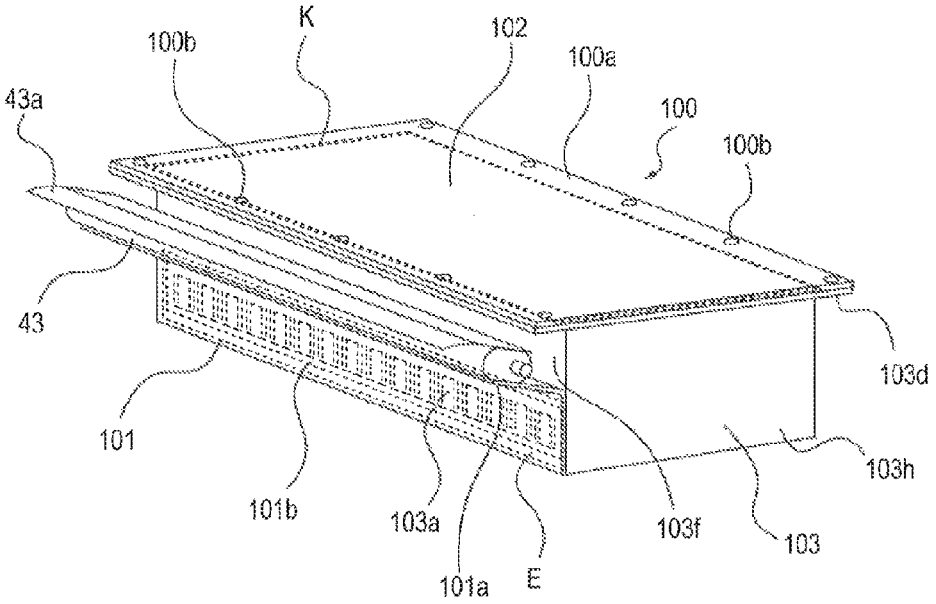
FIG. 7 is a perspective illustration showing a structure of the developer bag in Embodiment 1.

Next, a structure of the developing unit 20 will be described with reference to FIGS. 2, 3, 4, 6, 7, 9 and 10. FIG. 6 is an exploded perspective view showing a structure of the developing unit 20. FIG. 7 and (a) of FIG. 10 are a perspective illustration and a sectional illustration, respectively, showing a structure of the developing unit 20 in a state in which a sealing member 101 for sealing a toner discharge hole 103*a* as an opening provided in the developer bag 100 is not unsealed.

As shown in FIG. 3, a developing (device) frame 2 as a frame consisting of the toner accommodating container 21, the cap member 22 and the developing container 23 includes the toner chamber 29 in which the developer bag 100 is accommodated, and includes the toner feeding chamber 28. The toner accommodating container 21, the cap member 22 and the developing container 23 are integrally connected with each other by welding or the like.

As shown in FIG. 10, the developer bag 100 accommodates the toner T. As shown in FIG. 7, the sealing member 101 is fixed on the developer bag 100 in a peelable manner in a state in which a sealing portion 101*b* provided at an end portion of the sealing member 101 for sealing the toner discharge hole 103*a* provided in the developer bag 100 seals the toner discharge hole 103*a*.

A fixing portion 101*a* provided at another end portion of the sealing member 101 is fixed on an outer peripheral surface of the feeding member 43 functioning as an unsealing means for unsealing the toner discharge hole 103*a* of the developer bag 100 sealed with the sealing portion 101*b* of the sealing member 101.

As shown in FIGS. 9 and 10, fixing bosses 22*a* projected downward vertically from an outer peripheral edge portion of the cap member 22 constituting the frame are inserted into fixing holes 100*b* provided by penetrating a flange portion 100*a* provided at an upper portion of the developer bag 100. Then, end portions 22*b* of the fixing bosses 22*a* are crushed by being heated and melted. Retention of the fixing holes 100*b* are made by the crushed and extended end portions 22*b* of the fixing bosses 22*a*. As a result, the developer bag 100 is fixed, at its upper portion, to the cap member 22 as the frame.

As shown in FIG. 6, the feeding member 43 is rotatably supported by the toner accommodating container 21 in a non-driving side shown in a right side of FIG. 6, and is rotationally driven, by a rotationally driving force transmitted to a feeding gear 50 rotatably mounted on the toner accommodating container 21, in a driving side shown in a left side of FIG. 6. The feeding member 43 is rotated in the toner chamber 29 by the rotational drive of the feeding gear 50.

The developing blade 4 is constituted by including a supporting member 42*a* formed with a metal plate and including an elastic member 42*b* formed of an elastic material such as an urethane rubber, and is fixed together with a cleaning member 47 in a predetermined position relative to the developing container 23 by screws 93. The elastic member 42*b* contacts the surface of the developing roller 32, and defines a layer thickness of the toner T deposited on the peripheral surface of the developing roller 32 and also imparts triboelectric charges to the toner T.

The cleaning member 47 contacts the surface of the gap holding member 38 provided at each of the end portions of the developing roller 32 with respect to the rotational axis direction of the developing roller 32, so that a deposited matter such as the toner T deposited on the surface of the gap holding member 38 is removed.

A developing roller unit 31 is constituted by including the developing roller 32, the magnet roller 34, the flange 35, the gap holding member 38, a bearing member 37, a developing roller gear 39 and the like. From an end portion of the developing roller 32 in the non-driving side shown in the right side of FIG. 6, the magnet roller 34 is inserted into the cylindrical developing roller 32, and at the cylindrical end portion in the non-driving side, the flange 35 is press-fitted and fixed. In the flange 35, an unshown electroconductive electrode wire is incorporated, and the electrode wire is contacted to the developing roller 32 and an electrode plate 27 is an electrically conduction manner.

The electrode plate 27 having electroconductivity is fixed on a left side member 26L. The electrode plate 27 contacts and supplies electric power to an unshown electric power supplying portion as a developing bias power source in the main assembly of the image forming apparatus A, so that a developing bias voltage is applied, to the developing roller 32, from the electric power supplying portion of the main assembly of the image forming apparatus A through the electrode plate 27 and an unshown electrode wire as an electric power supplying path.

The gap holding member 38 is mounted at each of the end portions of the developing roller 32 with respect to the rotational axis direction (left-right direction in FIG. 6) of the developing roller 32. Further, outside the gap holding member 38, the bearing member 37 for rotatably shaft-supporting the developing roller 32 is disposed, and in the driving side shown in the left side of FIG. 6, the developing roller gear 39 is provided outside the bearing member 37.

Gears 48 and 49 as a drive transmission member are engaged with each other and are rotatably mounted on the developing frame 2. The gear 49 is engaged with a feeding gear 50, and the gear 48 is engaged with the developing roller gear 39. As a result, the rotational driving force received from the driving shaft 14 of the main assembly of the image forming apparatus A shown in FIG. 2 is transmitted to the driving force receiving portion 63*a* shown in FIG. 4, so that the photosensitive drum 62 is rotated. Further, a flange gear portion 63*b* provided on the photosensitive drum 62 at an end portion with respect to the rotational axis direction of the photosensitive drum 62 is rotated integrally with the photosensitive drum 62.

The flange gear portion 63*b* is engaged with the developing roller gear 39 shown in FIG. 6. As a result, the developing roller gear 39, the gears 48 and 49, and the feeding gear 50 are successively engaged with each other, so that the rotational driving force is transmitted. Then, the rotational driving force received from the main assembly of the image forming apparatus A is transmitted from the developing roller 32 integrally rotated with the developing roller gear 39 to the feeding member 43 integrally rotated with the feeding gear 50.

As shown in FIG. 6, the left side member 26L and the right side member 26R are fixed with screws 92 at end portions of the developing frame 2 with respect to the longitudinal direction (left-right direction in FIG. 6). At that time, the bearing members 37 disposed at the end portions of the developing roller unit 31 with respect to the longitudinal direction (left-right direction in FIG. 6) of the developing roller unit 31 are held by the left and right side members 26L and 26R.

<Structure of Developer Bag>

Figure 8:
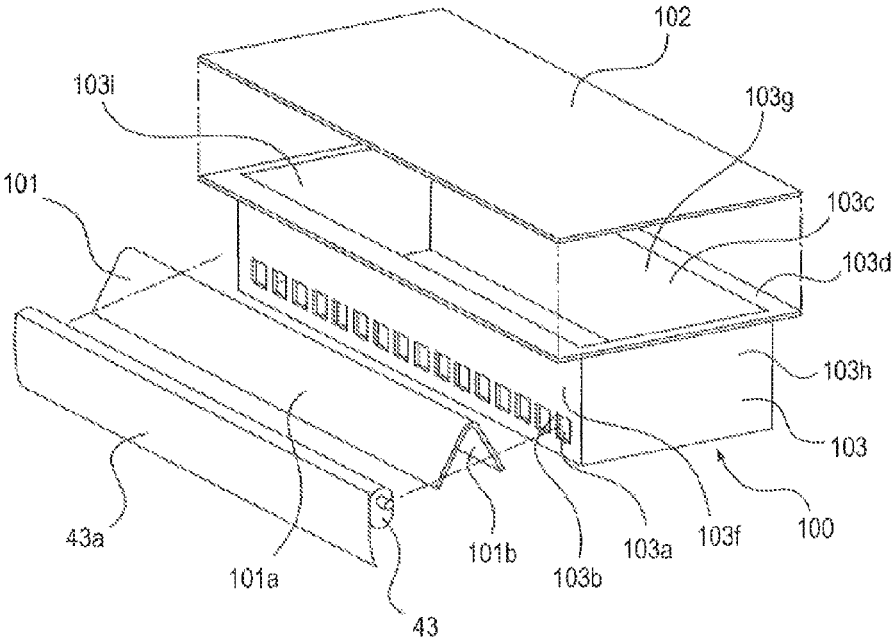
FIG. 8 is an exploded perspective view showing the structure of the developer bag in Embodiment 1.

Next, a structure of the developer bag 100 will be described with reference to FIGS. 7 and 8. FIG. 7 is a perspective view showing an assembled structure of the developer bag 100 with the feeding member 43. FIG. 8 is an exploded perspective view for illustrating structures of the developer bag 100 and the feeding member 43.

As shown in FIGS. 7 and 8, the developer bag 100 includes a flexible toner accommodating member 103 which is open at its upper portion and which has a three-dimensional shape, and includes a flexible seal member 102 for closing (covering) an upper opening of the toner accommodating member 103. At a lower portion of a front surface portion 103*f* provided to the toner accommodating member 103 in a side toward the developing roller 32, the toner discharge holes 103*a* are formed. The toner discharge holes 103*a* are formed in a rectangular shape with a predetermined pitch in the neighborhood of a bottom portion 100*e* of the toner accommodating member 103 and along the longitudinal direction (left-right direction in FIG. 7) of the toner accommodating member 103 in a line shape. The toner discharge holes 103*a* is sealed by the sealing portion 101*b* provided at one end of the flexible sealing member 101. The developer bag 100 is constituted by including the seal member 102, the toner accommodating member 103 and the sealing member 101.

The toner accommodating member 103 is prepared by subjecting a flexible sheet-like member to vacuum molding, air-pressure molding, press molding or the like. The toner accommodating member 103 is provided with the toner discharge holes 103*a* as the opening for permitting discharge of the accommodated toner T. The toner discharge holes 103*a* are partitioned by a plurality of connecting portions 103*b* provided along the longitudinal direction (left-right direction in FIG. 7) of the toner accommodating member 103.

As shown in FIG. 7, the sealing member 101 is provided with the sealing portion 101*b* for covering the toner discharge holes 103*a* formed at the front surface portion 103*f* of the toner accommodating member 103 and is provided with the fixing portion 101*a* to be fixed on the feeding member 43 functioning as the unsealing means.

The sealing portion 101*b* of the sealing member 101 is (thermally) welded at the front surface portion 103*f* of the toner accommodating member 103 so as to cover the toner discharge holes 103*a* of the toner accommodating member 103, thus sealing the toner discharge holes 103*a*. FIG. 7 shows a peripheral portion of the toner discharge holes 103*a* at the front surface portion 103*f* of the toner accommodating member 103 and a shape of a welded portion E with the sealing portion 101*b* of the sealing member 101.

In this embodiment, as a material for the sealing member 101, a laminate material having a special sealant layer which exhibits an easy peeling property (easy-to-peel property) is applied. The easy peeling property in this embodiment is such that peeling strength is about 3N/15 mm in testing methods for heat sealed flexible package according to JIS-Z0238. Further, as a material for the toner accommodating member 103, a flexible material which is weldable with the special sealant layer is applied, so that it is possible to provide the easy peeling property at the thermal welding portion.

As shown in FIG. 7, the toner discharge holes 103*a* of the toner accommodating member 103 are sealed by the sealing portion 101*b* of the sealing member 101, and thereafter the toner T is filled in the toner accommodating member 103 through an opening 103*c* of the toner accommodating member 103 shown in FIG. 8. When the toner T is filled, a known auger-type filling device is used. Alternatively, a filling method (means) having a similar function may also be used.

After the toner T is filled in the toner accommodating member 103, the opening 103*c* of the toner accommodating member 103 is closed (sealed) by the seal member 102. The seal member 102 is constituted by a flexible sheet member. The seal member 102 is provided with minute holes through which air is permeable.

After the toner T is filled in the toner accommodating member 103, a peripheral edge portion of the seal member 102 is thermally welded with the flange portion 103*d* provided at an outer peripheral edge of the toner accommodating member 103 so as to seal the opening 103*c* of the toner accommodating member 103. FIG. 7 shows a shape of a welded portion K between the flange portion 103*d* provided at the outer peripheral edge of the toner accommodating member 103 and the peripheral edge portion of the seal member 102.

The toner T is confined in the developer bag 100 constituted by the toner accommodating member 103, the sealing portion 101*b* of the sealing member 101, and the seal member 102. Thereafter, the fixing holes 100*b* consisting of the plurality of through-holes are perforated with a predetermined pitch in the flange portion 103*d* formed by superposedly thermally welding the flange portion 103*d*, provided at the outer peripheral edge of the toner accommodating member 103 of the developer bag 100, with the peripheral edge portion of the seal member 102.

On the other hand, the fixing portion 101*a* of the sealing member 101 is fixed on the outer peripheral surface of the feeding member 43. As a fixing method thereof, it is possible to use thermal welding, ultrasonic welding, pseudo bonding, or the like. Further, it is also possible to use a method in which the fixing portion 101*a* of the sealing member 101 is hung on projections provided on the outer peripheral surface of the feeding member 43 through through-holes provided in the fixing portion 101*a*.

<Accommodating Structure of Developer Bag in Developing Frame>

Next, with reference to FIGS. 6 and 9, an accommodating structure of the developer bag 100 in the developing frame 2 will be described. Parts (a) and (b) of FIG. 9 are perspective views for illustrating a fixing method between the cap member 22 constituting the frame and the developer bag 100.

As shown in (a) of FIG. 9, the plurality of fixing bosses 22*a* provided so as to be projected from the lower surface of the cap member 22 are inserted into the plurality of fixing holes 100*b* provided in the flange portion 100*a* of the developer bag 100. Thereafter, as shown in (b) of FIG. 9, the end portions 22*b* of the fixing bosses 22*a* are crushed by being heated and melted. As a result, the fixing bosses 22*a* are prevented from being disengaged from the fixing holes 100*b* by the end portions 22*b* each crushed and extended so as to have a diameter larger than a diameter of the associated fixing hole 100*b*. In this way, the developer bag 100 is fixed at its upper portion to the cap member 22 constituting the frame.

A fixing method between the cap member 22 and the developer bag 100 is not limited to the above fixing method employed in this embodiment. That is, it is possible fix these members by thermal welding, bonding or the like. Further, a fixing method in which the flange portion 100*a* of the developer bag 100 is hung, through the plurality of the fixing holes 100*b* provided therein, from a plurality of hook portions provided at the lower surface of the cap member 22.

In this way, after the upper portion of the developer bag 100 is fixed to the cap member 22, as shown in FIG. 6, the developer bag 100 is accommodated in the toner accommodating container 21 which has the three-dimensional shape and which is open at its upper portion.

<Unsealing Operation of Developer Bag>

Next, with reference to (a) to (c) of FIG. 10, an unsealing operation of the developer bag 100 will be described. Part (a) of FIG. 10 is a sectional illustration showing a state before the sealing portion 101*b* of the sealing member 101 fixed on the feeding member 43 of the developing unit 20 is peeled from the front surface portion 103*f* of the toner accommodating member 103 to unseal the toner discharge holes 103*a*. Part (b) of FIG. 10 is a sectional illustration showing a state in which the sealing portion 101*b* of the sealing member 101 fixed on the feeding member 43 of the developing unit 20 is being peeled from the front surface portion 103*f* of the toner accommodating member 103 to unseal the toner discharge holes 103*a*. Part (c) of FIG. 10 is a sectional illustration showing a state after the sealing portion 101*b* of the sealing member 101 fixed on the feeding member 43 of the developing unit 20 is peeled from the front surface portion 103*f* of the toner accommodating member 103 to unseal the toner discharge holes 103*a*.

The developer bag 100, the sealing member 101 and the feeding member 43 functioning as the unsealing means are accommodated in the toner chamber 29 of the developing unit 20. An unused process cartridge B is mounted in the main assembly of the image forming apparatus A. Then, the rotational driving force is transmitted from a driving shaft 14 shown in FIG. 2 in the main assembly of the image forming apparatus A to the feeding member 43 via the driving force receiving portion 63*a* and the flange gear portion 63*b* which are shown in FIG. 4, and the developing roller gear 39, the gears 48 and 49 and the feeding gear 50 which are shown in FIG. 6.

Then, from a state before the toner discharge holes 103*a* are unsealed as shown in (a) of FIG. 10, the feeding member 43 is rotated in a rotational direction indicated by an arrow G in (a) of FIG. 10. At this time, as shown in (b) of FIG. 10, the sealing member 101 fixed on the outer peripheral surface at its fixing portion 101*a* is wound up abound the outer peripheral surface of the feeding member 43. At the same time, the welded portion E between the sealing portion 101*b* of the sealing member 101 and the front surface portion 103*f* of the toner accommodating member 103 is gradually peeled, so that the toner discharge holes 103*a* formed by penetrating through the front surface portion 103*f* of the toner accommodating member 103 are started to be exposed.

Further, when the rotational driving force is transmitted from the main assembly of the image forming apparatus A, as shown in (c) of FIG. 10, the sealing member 101 is completely wound up around the outer peripheral surface of the feeding member 43, so that the toner discharge holes 103*a* formed at the front surface portion 103*f* of the toner accommodating member 103 are completely exposed. Thus, the toner T in the developer bag 100 is discharged into the toner chamber 29 via the toner discharge holes 103*a*.

<Toner Discharging Operation>

Next, with reference to FIGS. 11 and 12, an operation for discharging the toner T, accommodated in the developer bag 100, into the toner chamber 29 will be described. As shown in (c) of FIG. 10, when the toner discharge holes 103*a* formed at the front surface portion 103*f* of the toner accommodating member 103 are completely exposed, a part of the toner T is discharged into the toner chamber 29 from the toner discharge holes 103*a* by a force acting in an arrow J direction of (c) of FIG. 10 due to gravitation.

As shown in (a) to (c) of FIG. 11, the sheet member 43*a*, fixed on the outer peripheral surface of the feeding member 43 as the acting member, which periodically contacts the developer bag periodically contacts the front surface portion 103*f* of the developer bag 100 by the rotation of the feeding member 43. As a result, the developer bag 100 is constituted so as to be swingable. As a result, the toner T remaining in the developer bag 100 is discharged.

Parts (a) to (c) of FIG. 11 are sectional illustrates successively showing a state in which the feeding member 43 is rotated in the rotational direction indicated by the arrow G in FIG. 11. Part (a) of FIG. 11 shows a state before the sheet member 43*a* of the feeding member 43 contacts the front surface portion 103*f* of the toner accommodating member 103. Thereafter, when the feeding member 43 is rotated in the arrow G direction in (b) of FIG. 11, as shown in (b) of FIG. 11, the sheet member 43*a* as the acting member contacts the front surface portion 103*f* of the developer bag 100 to strike the front surface portion in the right direction in (b) of FIG. 11.

At this time, the entire developer bag 100 receives an urging force F1 in the right direction in (b) of FIG. 11 from the sheet member 43*a* via the front surface portion 103*f*. As a result, the whole developer bag 100 having flexibility is deformed. The bottom portion 103*e* of the developer bag 100 and the toner T in the neighborhood of the bottom portion 103*e* are moved in an arrow H direction in (b) of FIG. 11 while being accelerated in the developer bag 100. At this time, on the toner T in the developer bag 100, force of inertia such that the toner T is relatively moved in the arrow J direction in the developer bag 100 acts.

The toner T in the developer bag 100 is gradually moved toward the toner discharge holes 103*a* by gravitation and the force in the arrow J direction in (b) of FIG. 11 due to the force of inertia. Further, when the feeding member 43 is rotated in the arrow G direction as shown in (c) of FIG. 11, the sheet member 43*a* is spaced from the front surface portion 103*f* of the developer bag 100. At this time, the urging force F1 applied from the sheet member 43*a* to the developer bag 100 is released, so that the shape of the developer bag 100 deformed by the urging force F1 from the sheet member 43*a* is restored to the shape as shown in (c) of FIG. 11 by its own restoring force and a self-weight of the toner T.

Then, the bottom portion 103*e* of the developer bag 100 and the toner T in the neighborhood of the bottom portion 103*e* are moved in the arrow J direction in (c) of FIG. 11 while being accelerated in the developer bag 100. At this time, force of inertia acts on the toner T in an arrow H direction in (c) of FIG. 11, but is cancelled by the force in the arrow J direction in (c) of FIG. 11 due to gravitation acting on the toner T. As a result, the force for moving the toner T in the arrow H direction in (c) of FIG. 11 is eliminated or weaken.

Thereafter, the awing of the developer bag 100 is stopped. At this time, the force of inertia such that the toner T is moved in the developer bag 100 in the arrow J direction in (c) of FIG. 11 acts on the toner T in the developer bag 100. As a result, the toner T in the developer bag 100 is moved toward the toner discharge holes 103*a*, formed at the front surface 103*f*, by gravitation and the force in the arrow J direction in (c) of FIG. 11 due to the force of inertia.

The sheet member 43*a* as the acting member fixed on the feeding member 43 rotated in the arrow G direction in (b) of FIG. 11 strikes the front surface portion 103*f* of the developer bag 100, so that the developer bag 100 is swung. The present inventors measured displacement, speed change and acceleration of swing motion of the toner T in the developer bag 100 at that time. Thus, the present invention empirically confirmed that the above-described force of inertia acts on the toner T in the developer bag 100.

In this experiment, the developer bag 100 was slowly swung in the arrow H direction shown in (b) of FIG. 11 and thereafter the swung was instantaneously released (eliminated). Then, the displacement of a measuring portion 100*d* provided at a rear surface portion 103*g* in an opposite side of the developer bag 100 from the developing roller 32 was measured by using an unshown laser displacement gage. On the basis of the displacement of the measuring portion 100*d* measured by the laser displacement gage, the displacement, the speed and the acceleration of the swung developer bag 100 were obtained.

Parts (a), (b) and (c) of FIG. 12 shows timewise progression of the displacement, the speed and the acceleration, respectively, of the swung developer bag 100 obtained on the basis of the displacement of the measuring portion 100*d* measured by the laser displacement gage. In (a) to (c) of FIG. 12, the abscissa represents an elapsed time. In (a) of FIG. 12, the ordinate represents the displacement with respect to the arrow H and J directions in (b) of FIG. 11. In (b) of FIG. 12, the ordinate represents the speed with respect to the arrow H and J directions in (b) of FIG. 11. In (c) of FIG. 12, the ordinate represents the acceleration with respect to the arrow H and J directions in (b) of FIG. 121.

In the abscissa of each of (a) to (c) of FIG. 12, a swing start time of the developer bag 100 is t1, a swing release time of the developer bag 100 is t2, and a swing stop time of the developer bag 100 is t3. Further, in the ordinate of each of (a) to (c) of FIG. 12, an upward direction represents the arrow J direction in (b) of FIG. 11, and a downward direction represents the arrow H direction in (b) of FIG. 11.

As is understood from graphs of the displacement, the speed and the acceleration shown in (a), (b) and (c) of FIG. 12, respectively, the developer bag 100 is slowly moved from the swing start time t1 in the arrow H direction in (b) of FIG. 11. Then, as shown in (c) of FIG. 12, immediately before the swing release time t2, the acceleration in the arrow J direction in (c) of FIG. 11 is generated. At this time, the force of inertia acts on the toner T in the developer bag 100 in the arrow H direction in (c) of FIG. 11.

Further, as shown in (c) of FIG. 12, immediately before the swing stop time t3, the acceleration in the arrow H direction in (c) of FIG. 11 is generated. At this time, the force of inertia acts on the toner T in the developer bag 100 in the arrow J direction in (c) of FIG. 11.

In this way, by the experiment, as described above with reference to (c) of FIG. 11, the force acting on the toner T in the developer bag 100 by the swing of the developer bag 100 after the sheet member 43*a* was spaced from the front surface portion 103*f* of the developer bag 100 was confirmed.

As described above, the developer bag 100 cause the swing motion by contact and spacing (separation) between the developer bag 100 and the sheet member 43*a*. With the swing motion, the developer bag 100 is vibrated. As a result, the toner T deposited on the inner wall of the developer bag 100 is dropped onto the bottom of the developer bag 100. Similarly, by the swing motion and the vibration of the developer bag 100, the toner T in the developer bag 100 is satisfactorily loosen.

The contact and spacing between the developer bag 100 and the sheet member 43*a* as the acting member are periodically repeated during the transmission of the driving force from the main assembly of the image forming apparatus A to the process cartridge B. The above-described swing motion and the vibration of the developer bag 100 successively action the toner T, so that the toner T in the developer bag 100 is satisfactorily discharged from the toner discharge holes 103*a*.

Figure 5:
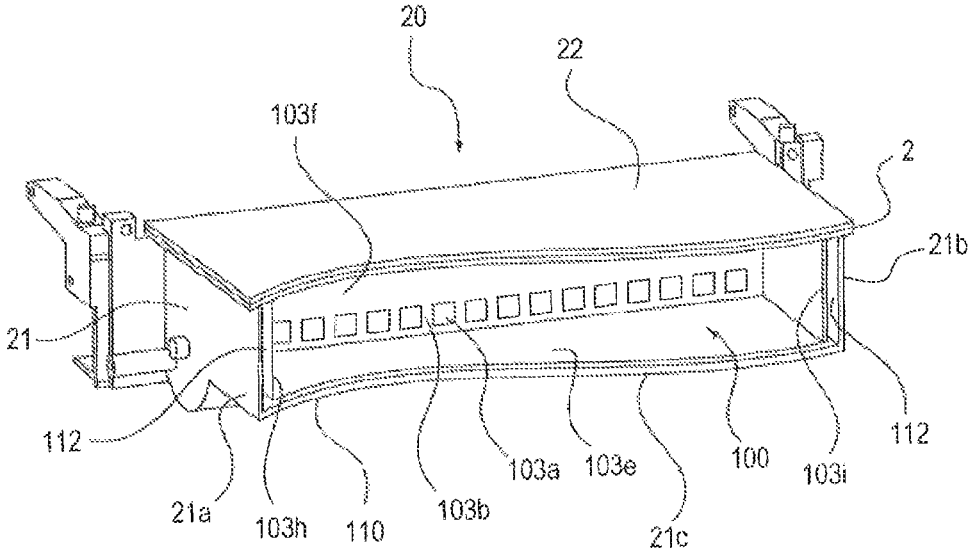
FIG. 5 is a perspective illustration showing an arrangement of a developer bag inside a frame in a state in which a part of the process cartridge also functioning as the developing cartridge in Embodiment 1 is cut.

FIG. 5 is a perspective view showing a part of the developer bag 100 in cross section. For convenience of explanation, a part of elements of the developer bag 100 is omitted. As shown in FIG. 5, in a swing range of the developer bag 100, at least one space is provided between the developer bag 100 and the toner accommodating container 21 constituting the frame. In this embodiment, a side space 112 is provided between a left side surface portion 103*h* of the developer bag 100 and a left side surface portion 21*a* of the toner accommodating container 21 with respect to the longitudinal direction (left-right direction in FIG. 5) and between a right side surface portion 103*i* of the developer bag 100 and a right side surface portion 21*b* of the toner accommodating container 21 with respect to the longitudinal direction (left-right direction in FIG. 5).

Similarly, as shown in (a) to (c) of FIG. 11, a lower space 110 is provided between the bottom portion 103*e* of the developer bag 100 and a bottom portion 21*c* of the toner accommodating container 21. Further, are rear space 111 is provided between the rear surface portion 103*g* of the developer bag 100 and a rear surface portion 21*d* of the toner accommodating container 21.

By the above constitution, prevention of the swung and the vibration of the developer bag 100 by friction of the developer bag 100 with the toner accommodating container 21 can be eliminated. Therefore, a toner T-discharging effect by the swing and the vibration of the developer bag 100 can be satisfactorily achieved. In this way, the toner T discharged from the toner discharge holes 103*a* of the developer bag 100 into the toner chamber 29 of the toner accommodating container 21 is fed to the toner feeding (supplying) chamber 28, communicating with the toner chamber 29, by the rotating feeding member 43.

In this embodiment, the acting member periodically contacting the developer bag 100 was constituted by the sheet member 43*a* fixed on the rotating feeding member 43. As a result, the swing and the vibration of the developer bag 100 and the feeding of the toner T can be performed by the same member. For this reason, the structure is simple, thus also contributing to reduction in number of parts.

Thus, according to the process cartridge B also functioning as the developing cartridge in this embodiment, the toner T in the developer bag 100 can be satisfactorily discharged from the toner discharge holes 103*a*, so that a residual amount of the toner T remaining in the developer bag 100 can be reduced.

Embodiment 2

Next, with reference to FIGS. 13 and 14, a developing cartridge according to the present invention, a process cartridge and an image forming apparatus to which the process cartridge is detachably mountable in a constitution in this embodiment will be described. Incidentally, constituent elements similar to those in Embodiment 1 are represented by the same reference numerals or symbols and will be omitted from description.

In Embodiment 1, the constitution in which as the acting member periodically contacting the developer bag 100, the sheet member 43*a* fixed on the rotationally driven feeding member 43 is contacted to the front surface portion 103*f* of the developer bag 100 to swing the developer bag 100 was employed.

In this embodiment, as shown in (b) of FIG. 14, a constitution in which as the acting member contacting the developer bag, the feeding member to be rotationally driven is directly contacted to the front surface portion 103*f* of the developer bag 100 to swing the developer bag 100 was employed.

As shown in FIG. 13, in this embodiment, the feeding member 43 is provided as the acting member for swinging and vibrating the developer bag 100. The feeding member 43 is, similarly as in Embodiment 1, rotatably supported by the toner accommodating container 21 in the non-driving side shown in the right side of FIG. 6, and is rotationally driven with rotation of the feeding gear 50 rotatably mounted on the toner accommodating container 21 in the driving side shown in the left side of FIG. 6. As a result, the feeding member 43 is rotated in the toner chamber 29 by the rotation of the feeding gear 50.

As shown in FIG. 13, the fixing portion 101*a* of the sealing member 101 for sealing the toner discharge holes 103*a* formed at the front surface portion 103*f* of the developer bag 100 is fixed on the outer peripheral surface of the feeding member 43.

Then, an unused process cartridge B is mounted in the main assembly of the image forming apparatus A. Then, similarly as in Embodiment 1, the rotational driving force is transmitted from the driving shaft 14 shown in FIG. 2 in the main assembly of the image forming apparatus A to the feeding member 43. The rotational driving force to be transmitted to the feeding member 43 is transmitted to the feeding member 43 via the driving force receiving portion 63*a* and the flange gear 63*b* which are shown in FIG. 4, and the developing roller gear 39, the gears 48 and 49 and the feeding gear 50 which are shown in FIG. 6.

When the feeding member 43 is rotated, the sealing member 101 is wound up along the outer peripheral surface of the feeding member 43. At the same time, the welded portion E of the sealing portion 101*b* thermally welded with the front surface portion 103*f* of the toner accommodating member 103 is gradually peeled. Then, the toner discharge holes 103*a* provided by penetrating through the front surface portion 103*f* of the toner accommodating member 103 are exposed.

Next, with reference to (a) to (c) of FIG. 14, an operation for discharging the toner T accommodated in the developer bag 100 into the toner chamber 29 through the toner discharge holes 103*a* will be described. Parts (a) to (c) of FIG. 14 successively show a state in which the feeding member 43 is rotated in the rotational direction indicated by the arrow G in these figures.

Part (a) of FIG. 14 is a sectional illustration showing a state before the feeding member 43 is contacted to the front surface portion 103*f* of the developer bag 100. Thereafter, when the feeding member 43 is gradually rotated in the arrow G direction in (b) of FIG. 14, as shown in (b) of FIG. 14, a long-diameter portion of the feeding member 43 is contacted to the front surface portion 103*f* of the developer bag 100. At this time, the front surface portion 103*f* of the developer bag 100 receives the urging force F1 from the feeding member 43.

In this case, the flexible developer bag 100 is deformed and moved in the arrow H direction in (b) of FIG. 14 at the bottom portion 103*e* of the toner accommodating member 103. Further, when the feeding member 43 is rotated in the arrow G direction in (c) of FIG. 14, as shown in (c) of FIG. 14, the feeding member 43 is spaced from the front surface portion 103*f* of the developer bag 100. At this time, the urging force F1 applied from the feeding member 43 to the developer bag 100 is eliminated, so that the shape of the developer bag 100 is restored by its own restoring force and the self-weight of the toner T and concurrently the bottom portion 103*e* of the toner accommodating member 103 is moved in the arrow J direction in (c) of FIG. 14.

The contact and the spacing between the long-diameter portion of the feeding member 43 and the front surface portion 103*f* of the developer bag 100 are periodically repeated by the rotation of the feeding member 43. Similarly as in Embodiment 1, into the fixing holes 100*b* provided in the flange portion 100*a* of the developer bag 100, the fixing bosses 22*a* projected downward from the lower surface of the cap member 22 constituting the frame are inserted, and then the end portions 22*b* of the fixing bosses 22*a* are crushed by being heated and melted. By the crushed and extended end portions 22*b* of the fixing bosses 22*a*, the fixing bosses 22*a* are prevented from being disengaged from the fixing holes 100*b*. As a result, the upper portion of the developer bag 100 is fixed to the cap member 22 constituting the frame.

Then, the long-diameter portion of the rotating feeding member 43 periodically contacts the front surface portion 103*f* of the developer bag 100 to cause the swing motion of the developer bag 100. The developer bag 100 is vibrated with the swing motion.

An operation for discharging the toner T into the toner chamber 29 from the toner discharge holes 103*a* provided at the front surface portion 103*f* of the developer bag 100 is similar to that in Embodiment 1, and therefore will be omitted from description. Other constitutions are the same as those in Embodiment 1, and a similar effect can be obtained.

Embodiment 3

Next, with reference to FIGS. 15 and 16, a developing cartridge according to the present invention, a process cartridge and an image forming apparatus to which the process cartridge is detachably mountable in a constitution in this embodiment will be described. Incidentally, constituent elements similar to those in the above-described embodiments are represented by the same reference numerals or symbols and will be omitted from description.

FIG. 15 is a perspective view showing a part of a developing unit 20 in cross section in this embodiment. As shown in FIG. 15, in this embodiment, in addition to the constituent elements in Embodiment 1, a constitution in which an elastic member 120 actable on the developer bag 100 is provided, and with respect to the swing of the developer bag 100, accumulation and release of an elastic force of the elastic member 120 are effected is employed.

In this embodiment, as shown in FIG. 15, a fixed projection 21*f*, a mounting member 121 and the elastic member constituted by a coil spring extending between the fixed projection 21*f* and the mounting member 121 are mounted in each of left and right sides of the developing unit 20. The fixed projection 21*f* is provided on an inner wall surface of the side surface portion 21*a* or 21*b* of the toner accommodating container 21 in a front surface portion 21*e* side. The mounting member 121 is provided on the outer peripheral surface of the side surface portion 103*h* or 103*i* of the developer bag 100 in the side close to the front surface portion 103*f*.

The elastic member 120 is locked at its end by the fixing projection 21*f* of the toner accommodating container 21 and is locked at its another end by the mounting member 121. The mounting members 121 are fixed on the side surface portions 103*h* and 103*i* of the developer bag 100 by a method such as (thermal) welding or bonding.

Next, with reference to (a) to (c) of FIG. 16, an operation for discharging the toner T accommodated in the developer bag 100 into the toner chamber 29 through the toner discharge holes 103*a* will be described. Parts (a) to (c) of FIG. 16 are sectional illustrations successively show a state in which the feeding member 43 is rotated in the rotational direction indicated by the arrow G in these figures.

Part (a) of FIG. 16 is a sectional illustration showing a state before the sheet member 43*a* fixed on the rotating feeding member 43 is contacted to the front surface portion 103*f* of the developer bag 100. At this time, the elastic member 120 is not deformed, so that an elastic force by the elastic members 120 does not act on the side surface portions 103*h* and 103*i* of the developer bag 100.

As shown in (b) of FIG. 16, the feeding member 43 is rotated in the arrow G direction in (b) of FIG. 16, so that the sheet member 43*a* as the acting member is contacted to the front surface portion 103*f* of the developer bag 100. Then, the developer bag 100 is swung in the arrow H direction in (b) of FIG. 16 by an urging force F2 from the sheet member 43*a*. At the same time, the elastic members 120 connected with the side surface portions 103*h* and 103*i* of the developer bag 100 at their ends are gradually pulled with movement of the developer bag 100 in the arrow H direction in (b) of FIG. 16, so that the elastic force for contracting the elastic members 120 is accumulated.

Further, as shown in (c) of FIG. 16, when the feeding member 43 is rotated in the arrow G direction in (c) of FIG. 16, the sheet member 43*a* is spaced from the front surface portion 103*f* of the developer bag 100. At this time, the elastic force, for contracting the elastic members 120, accumulated in the elastic members 120 is released without stopping, so that the developer bag 100 and the toner T accommodated therein are moved in the arrow J direction in (c) of FIG. 16.

Thereafter, the contracting elastic force of the elastic members 120 is completely released and concurrently the swing of the developer bag 100 is stopped. At this time, on the toner T in the developer bag 100, the force of inertia such that the toner T is moved in the arrow J direction in (c) of FIG. 16 in the developer bag 100 acts. In this way, the toner T in the developer bag 100 is moved toward the toner discharge holes 103*a* provided at the front surface portions 103*f* of the developer bag 100 by gravitation and the force in the arrow J direction in (c) of FIG. 16.

In this embodiment, it is possible to provide the toner T accommodated in the developer bag 100 with a large speed change by the accumulation and the release of the elastic force of the elastic members 120. As a result, the force of inertia during the stop of the swing of the developer bag 100 largely acts on the toner T, so that the toner T can be satisfactorily discharged from the toner discharge holes 103*a*.

As described above, also in the process cartridge B in this embodiment, the toner T in the developer bag 100 can be satisfactorily discharged from the toner discharged holes 103*a*, so that it is possible to reduce the amount of the toner remaining in the developer bag 10. Other constitutions are the same as those in the above-described embodiments, and a similar effect can be obtained.

Next, with reference to FIGS. 17 and 18, a developing cartridge according to the present invention, a process cartridge and an image forming apparatus to which the process cartridge is detachably mountable in a constitution in this embodiment will be described. Incidentally, constituent elements similar to those in the above-described embodiments are represented by the same reference numerals or symbols and will be omitted from description.

FIG. 17 is a perspective view showing a developing unit 20 in this embodiment from which a part of the developing unit 20 is cut away. Incidentally, for convenience of explanation, a part of components of the developing unit 20 is omitted. In this embodiment, in addition to Embodiment 1, a contact projection 21*g* projected upward from the bottom portion 21*c* of the toner accommodating container 21 is provided at a position corresponding to a contact portion 100*c* provided at a lower portion of the toner discharge holes 103*a* of the front surface portion 103*f* of the developer bag 100. Further, during the swing of the developer bag 100, the contact portion 100*c* provided at the front surface portion 103*f* of the developer bag 100 contacts the contact projection 21*g* provided on the bottom portion 21*c* of the toner accommodating container 21.

Next, with reference to (a) and (b) of FIG. 18, a discharging operation of the toner T in the developer bag 100 in this embodiment will be described. Parts (a) and (b) of FIG. 18 are sectional illustrations successively show a state in which the feeding member 43 is rotated in the rotational direction indicated by the arrow G in these figures.

As shown in (a) of FIG. 18, the feeding member 43 is gradually rotated in the arrow G direction in (a) of FIG. 18, so that the sheet member 43*a* as the acting member is contacted to the front surface portion 103*f* of the developer bag 100, and then, the developer bag 100 is swung in the arrow H direction in (a) of FIG. 18.

Further, as shown in (b) of FIG. 18, when the feeding member 43 is rotated in the arrow G direction in (b) of FIG. 18, the sheet member 43*a* is spaced from the front surface portion 103*f* of the developer bag 100. At this time, the elastic force F1 applied from the sheet member 43*a* to the developer bag 100 is released, so that the deformation of the developer bag 100 is eliminated and concurrently a lower portion of the developer bag 100 is moved in the arrow J direction in (b) of FIG. 18.

Thereafter, the contact portion 100*c* provided at the front surface portion 103*f* of the developer bag 100 contacts the contact projection 21*g* projected upward from the bottom portion 21*c* of the toner accommodating container 21, so that the swing of the developer bag 100 in the arrow J direction in (b) of FIG. 18 is forcedly stopped. By an abrupt speed change at this time, the toner T in the developer bag 100 is moved toward the toner discharge holes 103*a* by the force of inertia.

In this embodiment, by the contact between the contact projection 21*g* of the toner accommodating container 21 and the contact portion of the developer bag 100, with respect to the swing of the developer bag 100, it is possible to provide a large speed change. For this reason, the force of inertia during the stop of the developer bag 100 largely acts on the toner T, so that the toner T can be satisfactorily discharged from the toner discharge holes 103*a*.

As described above, also in the process cartridge B in this embodiment, the toner T in the developer bag 100 can be satisfactorily discharged, so that it is possible to reduce the amount of the toner remaining in the developer bag 100. Other constitutions are the same as those in the above-described embodiments, and a similar effect can be obtained.

Embodiment 5

Next, with reference to FIG. 19, a developing cartridge according to the present invention, a process cartridge and an image forming apparatus to which the process cartridge is detachably mountable in a constitution in this embodiment will be described. Incidentally, constituent elements similar to those in the above-described embodiments are represented by the same reference numerals or symbols and will be omitted from description.

In a constitution in this embodiment, in addition to the constitution in Embodiment 3, the sheet member 43*a* as the acting member periodically contacting the developer bag 100 is fixed on a side of an outer peripheral surface of a feeding member 43 having an almost triangular shape in cross section. Further, a rotation contact portion 43*b* which is a top portion of the feeding member 43 is contactable to the developer bag 100. That is, the sheet member as the acting member is integrally provided with the rotation contact portion 43*b* which is the top portion of the feeding member 43 and which is contactable to the developer bag 100.

Further, as shown in (a) of FIG. 19, the sheet member 43*a* as the acting member contacts the front surface portion 103*f* of the developer bag 100, so that the developer bag 100 receives an urging force F2 at the front surface portion 103*f* to be swung in the arrow H direction in (a) of FIG. 19. Thereafter, as shown in (b) of FIG. 19, when the sheet member 43*a* is detached from the front surface portion 103*f* of the developer bag 100, the developer bag 100 is swung toward an opening direction which is a direction of the toner discharge holes 103*a*. At that time, the rotation contact portion 43*b* which is the top portion of the feeding member 43 contacts the front surface portion 103*f* of the developer bag 100.

Next, with reference to (a) to (c) of FIG. 19, discharge of the toner T in the developer bag 100 will be described. Parts (a) to (c) of FIG. 19 successively show a state in which the feeding member 43 is rotated in the arrow G direction in these figures.

Part (a) of FIG. 19 shows a state in which the feeding member 43 is rotated in the arrow G direction in (a) of FIG. 19, so that the sheet member 43*a* as the acting member is contacted to the front surface portion 103*f* of the developer bag 100 and thus the developer bag 100 is swung in the arrow H direction in (a) of FIG. 19. At this time, concurrently, the elastic members 120 is pulled in the arrow H direction in (a) of FIG. 19, so that the elastic force for contracting the elastic members 120 is accumulated.

Further, when the feeding member 43 is rotated in the arrow G direction in (b) of FIG. 19, as shown in (b) of FIG. 19, the sheet member 43*a* and the front surface portion 103*f* of the developer bag 100 are spaced from each other. At this time, the contracting (elastic) force accumulated in the elastic members 120 is released without stopping, so that the developer bag 100 and the toner T accommodated therein are acceleratedly moved in the arrow J direction in (b) of FIG. 19.

Thereafter, the contact portion 100*c* provided at the front surface portion 103*f* of the developer bag 100 is rotated in the arrow G direction in (b) of FIG. 19 to contact the rotation contact portion 43*b* which is the top portion of the feeding member 43 which has reached a position opposing the front surface portion 103*f* of the developer bag 100. At this time, the swing of the developer bag 100 in the arrow J direction in (b) of FIG. 19 is forcedly stopped. Further, when the feeding member 43 is rotated in the arrow G direction in (b) of FIG. 19, the developer bag 100 is urged in the arrow H direction in (b) of FIG. 19 by the rotation contact portion 43*b*, and therefore the developer bag 100 is swung in the arrow H direction in (c) of FIG. 19 while being deformed.

By abrupt speed change of the toner T in the developer bag 100 at this time, the toner T in the developer bag 100 is moved toward the toner discharge holes 103*a* by the force of inertia, thus being discharged in the toner chamber 29 through the toner discharge holes 103*a*.

Also in this embodiment, the contracting force accumulated in the elastic member 120 is released without stopping, so that the developer bag 100 and the toner T therein can provide large acceleration during the swing of the developer bag 100 in the arrow J direction in (b) of FIG. 19. Further, the rotation contact portion 43*b* applies, to the developer bag 100, an urging force F3 in an opposite direction to the swing direction of the developer bag 100 indicated by the arrow J direction in (b) of FIG. 19. For this reason, a larger force of inertia can be exerted on the toner T, so that the toner T can be discharged satisfactorily through the toner discharge holes 103*a*.

As described above, also in the developing cartridge or the process cartridge B in this embodiment, the toner T in the developer bag 100 can be satisfactorily discharged from the toner discharge holes 103*a*, so that it is possible to reduce the amount of the toner remaining in the developer bag 100. Other constitutions are the same as those in the above-described embodiments, and a similar effect can be obtained.

Embodiment 6

Next, with reference to FIG. 20, a developing cartridge according to the present invention, a process cartridge and an image forming apparatus to which the process cartridge is detachably mountable in a constitution in this embodiment will be described. Incidentally, constituent elements similar to those in the above-described embodiments are represented by the same reference numerals or symbols and will be omitted from description.

In a constitution in this embodiment, an acting member 130 which periodically contacts the developer bag 100 and which has an almost cross shape in cross section is provided rotatably in the arrow G direction in FIG. 20. The acting member 130 is provided with contact portions 130*a*, 130*b*, 130*c* and 130*d* each constituted by a top portion thereof in a position shifted by 90 degrees from an adjacent contact portion with respect to a radial direction of the acting member 130. As a result, the acting member 130 is integrally provided with the contact portions 130*a* to 130*d*, each of which is contactable to the front surface portion 103*f* of the developer bag 100.

Further, as shown in (a) of FIG. 20, the contact portion 130*a* as the acting member 130 contacts the front surface portion 103*f* of the developer bag 100, so that the developer bag 100 receives an urging force F4 at the front surface portion 103*f* to be swung in the arrow H direction in (a) of FIG. 20. Thereafter, as shown in (b) of FIG. 20, when the contact portion 130*a* of the acting member 130 is detached from the front surface portion 103*f* of the developer bag 100, the developer bag 100 is swung toward an opening direction which is a direction of the toner discharge holes 103*a*. At that time, the contact portion 130*b* of the acting member 130 contacts the front surface portion 103*f* of the developer bag 100.

Next, with reference to (a) to (c) of FIG. 20, discharge of the toner T in the developer bag 100 in this embodiment will be described. Parts (a) to (c) of FIG. 20 successively show a state in which the acting member 130 is rotated in the arrow G direction in these figures.

Part (a) of FIG. 20 shows a state in which the acting member 130 is rotated in the arrow G direction in (a) of FIG. 20, so that the contact portion 130*a* of the acting member 130 is contacted to the contact portion 100*c* of the developer bag 100 and thus the developer bag 100 is swung in the arrow H direction in (a) of FIG. 20. At this time, the elastic members 120 is pulled, so that the elastic force for contracting the elastic member 120 is accumulated.

Further, when the acting member 130 is rotated in the arrow G direction in (b) of FIG. 20, as shown in (b) of FIG. 20, the contact portion 130*a* of the acting member 130 and the front surface portion 103*f* of the developer bag 100 are spaced from each other. At this time, the contracting (elastic) force accumulated in the elastic members 120 is released without stopping, so that the developer bag 100 and the toner T accommodated therein are acceleratedly moved in the arrow J direction in (b) of FIG. 20.

Thereafter, the contact portion 100*c* provided at the front surface portion 103*f* of the developer bag 100 is rotated in the arrow G direction in (b) of FIG. 20 to contact the contact portion 130*a* of the acting member 130 which has reached a position opposing the front surface portion 103*f* of the developer bag 100. At this time, the swing of the developer bag 100 in the arrow J direction in (b) of FIG. 20 is forcedly stopped. Further, when the acting member 130 is rotated in the arrow G direction in (b) of FIG. 20, the front surface portion 103*f* of the developer bag 100 is urged in the arrow H direction in (b) of FIG. 20 by the contact portion 130*a* of the acting member 130. For this reason, the developer bag 100 is swung in the arrow H direction in (c) of FIG. 20 while being deformed.

By abrupt speed change of the toner T in the developer bag 100 at this time, the toner T in the developer bag 100 is moved toward the toner discharge holes 103*a* by the force of inertia, thus being discharged in the toner chamber 29 through the toner discharge holes 103*a*.

Further, when the acting member 130 is rotated in the arrow G direction in (c) of FIG. 20, the contact portion 130*b* of the acting member 130 further deforms and swings the developer bag 100 similarly as in the case of the contact portion 130*a*, and thereafter is spaced from the front surface portion 103*f* of the developer bag 100. This motion is similarly performed also with respect to the contact portions 130*c* and 130*d* with progress of the rotation of the acting member 130.

Also in this embodiment, the contracting force accumulated in the elastic member 120 is released without stopping, so that the developer bag 100 and the toner T therein can provide large acceleration during the swing of the developer bag 100 in the arrow J direction in (b) of FIG. 20. Further, each of the contact portions 130*a* to 130*d* of the acting member 130 applies, to the developer bag 100, an urging force F4 in an opposite direction to the swing direction of the developer bag 100 indicated by the arrow J direction in (b) of FIG. 20. For this reason, a larger force of inertia can be exerted on the toner T, so that the toner T can be discharged satisfactorily through the toner discharge holes 103*a*.

Further, the acting member 130 is provided with the plurality of the contact portions 130*a* to 130*d*. As a result, during one full turn of the acting member 130, the motion consisting of "deformation and swing of developer bag 100", "spacing" and "deformation and swing of developer bag 100" can be performed plural times between the front surface portion 103*f* of the developer bag 100 and the contact portions 130*a* to 130*d*. For this reason, a large degree of the vibration can be added to the developer bag 100, and therefore it is possible to satisfactorily discharge the toner T through the toner discharge holes 103*a*.

As described above, also in the developing cartridge or the process cartridge B in this embodiment, the toner T in the developer bag 100 can be satisfactorily discharged from the toner discharge holes 103*a*, so that it is possible to reduce the amount of the toner remaining in the developer bag 100. Other constitutions are the same as those in the above-described embodiments, and a similar effect can be obtained.

Embodiment 7

Next, with reference to FIGS. 21 and 22, a process cartridge also functioning as a developing cartridge according to the present invention in a constitution in this embodiment will be described. Incidentally, constituent elements similar to those in the above-described embodiments are represented by the same reference numerals or symbols or by different reference numerals or symbols in some cases, and will be omitted from description.

<Structure of Process Cartridge>

A process cartridge B includes the photosensitive drum 62 as the image bearing member and the image forming process means actable on the photosensitive drum 62. The process cartridge B in this embodiment includes, as shown in FIG. 21, a cleaning unit 60 which includes, at a periphery of the photosensitive drum 62, the charging roller 66 as the charging means and the elastic cleaning blade 77 as the cleaning means.

Further, the process cartridge B includes the developing unit 20 including the frames 17 and 18. The process cartridge B is prepared by integrally assembling the cleaning unit 60 and the developing unit 20 and is constituted so as to be detachably mountable to the main assembly of the image forming apparatus 100. The developing unit 20 includes the developing roller 43 as the developing means, the developing blade 42, the toner accommodating container 21 for accommodating the toner T as the developer, and the feeding member 43 also functioning as a vibrating means. The feeding member 43 is provided with the sheet member 43*a* as the acting member periodically contacting the developer bag 100 with rotation of the feeding member 43 in the arrow G direction in FIG. 21.

Incidentally, in this embodiment, the developing cartridge is the same as the developing device. This is because the developing cartridge includes the developing roller 32 and the developing blade 42. However, the developing roller 32 and the developing blade 42 may also be supported by a separate frame from the developing cartridge and thus may be separated from the developing cartridge.

<Structure of Developer Accommodating Container>

Next, with reference to (a) and (b) of FIG. 22, a structure of the flexible developer bag 100 for accommodating the toner T as the developer will be described. Here, (a) of FIG. 22 is a perspective illustration of the developer bag 100 as seen from a front surface side where the toner discharge holes 103*a* as the opening are provided, and (b) of FIG. 22 is a perspective illustration of the developer bag 100 as seen from a rear surface side opposite from the front surface side (the toner discharge holes 103*a*).

The developer bag 100 is constituted by a molded portion 100*e* for accommodating the toner T and an air permeable portion 100*f* having air permeability. The molded portion 100*e* is molded member which is three-dimensionally formed by subjecting an about 0.2-0.3 mm thick polyethylene film to vacuum molding. The air permeable portion 100*f* is a sheet having air-permeability. The molded portion 100*e* and the air permeable portion 100*f* are superposed with each other and then are bonded together at a bonding portion 100*g* as a peripheral portion through full circumference. Inside the bonding portion 100*g*, an accommodating portion 100*h* for accommodating the toner T is formed, and outside the bonding portion 100*g*, an outer peripheral portion 100*i* is formed.

At a surface of the developer bag 100 in the front surface side (left side of (a) of FIG. 22), the toner discharge holes 103*a* as a plurality of openings are formed and arranged in an arrow M direction (longitudinal direction of the developing roller 32) in (a) of FIG. 22 in parallel to an axial direction of the developing roller 32.

Further, the plurality of toner discharge holes 103*a* are surrounded by a bonding portion 15 to be unsealably bonded by the sealing member 101, s that the toner T accommodated in the developer bag 100 is confined. The sealing member 101 is constituted by a laminate material having a sealant layer which exhibits an easy unsealing property, and a base material therefor may appropriately selected from materials of polyethylene terephthalate (PET), polyethylene, polypropylene and the like which are formed in a layer thickness of 0.03-0.15 mm.

<Structure of Developing Unit>

Next, with reference to FIG. 21, a structure of the developing unit 20 will be described. As shown in FIG. 21, the frame 18 is provided with fixing portions 101*a*, for fixing the developer bag 100, at an upper portion of FIG. 21 and in a remotest position from the developing roller 32. The fixing portions 101*a* are constituted by a plurality of bosses disposed along a longitudinal direction indicated by the arrow M in (a) of FIG. 22. The fixing of the developer bag 100 to the frame 18 is made by engaging fixing holes 100*b*, as portions-to-be-fixed, with the fixing portions 101*a* and then by thermally caulking the fixing portions 101*a*.

As a result, the developer bag 100 disposed inside the frames 17 and 18 is fixed to the frame 18 in a position above the toner discharge holes 103*a* with respect to the direction of gravitation. Then, when the feeding member 43 is rotated in the arrow G direction in FIG. 21 to drive the sheet member 43*a* as the acting member, the sheet member 43*a* contacts a peripheral portion of the toner discharge holes 103*a* as the opening for the developer bag 100, so that the developer bag 100 is swingable.

The toner T is fed in the arrow J direction in FIG. 21 from the side of the fixing holes 101*b* as the portions-to-be-fixed toward the toner discharge holes 103*a*. That is, the developer bag 100 is fixed to the frame 18 in the fixing holes 101*b* as the portions-to-be-fixed provided upstream (in the right side in FIG. 21) of the accommodating portion 100*h* with respect to a developer feeding direction. Further, the developer bag 10 is always contacted on the frame 18 by its self-weight. By disposing the developer bag 100 as described above, it is possible to prevent the toner T from entering a side under the developer bag 100.

Further, a contact surface 18*e* between the frame 18 and the developer bag 100 has a downward inclination slope from the fixing portions 101*a* toward a downstream side with respect to the developer feeding direction. A positional relationship between the fixing portions 101*a* of the developer bag 100 and the toner discharge holes 103*a* as the opening is as follows. That is, when the process cartridge B is used as the developing cartridge (when the developing cartridge is mounted in the main assembly of the image forming apparatus A), as seen from the direction of gravitation, the fixing portions 101*a* are disposed so as to be located above the upper end portion of the toner discharge holes 103*a* as the opening.

In a state in which the developing cartridge is mounted in the main assembly of the image forming apparatus, the contact surface 18*e* between the frame 18 and the developer bag 100 is set to have a predetermined inclination angle θ ($0° < \theta < 90°$) with respect to a horizontal surface h as shown in FIG. 21. Then, the toner discharge holes 103*a* as the opening and the fixing portions 101*a* are disposed in the bottom side of the developer bag 100.

After the developer bag 100 is fixed to the frame 18, the frame 17 is connected to the frame 16. A shape of the molded portion 100*e* of the developer bag 100 before the frame 17 is connected to the frame 18 is shown by a dotted line in FIG. 21. As shown in FIG. 21, the shape of the molded portion 100*e* of the developer bag 100 before the frame 17 is connected to the frame 18 is such that an upper surface in the upstream side (the right side in FIG. 21), with respect to the developer feeding direction, close to the fixing holes 100*b* as the portions-to-be-fixed is protruded from the upper surface of the frame 17.

When the frame 17 is connected to the frame 18, a protruded portion of the molded portion 100*e* of the developer bag 100 is pressed and crushed by the frame 17. At that time, in order to escape the crushed portion of the molded portion 100*e* of the developer bag 100, an escaping space N is provided between the upper side of the fixing holes 100*b* as the portions-to-be-fixed and the frame 17 in FIG. 21. The developer bag 100 is, in a state in which the developer bag 100 is accommodated in the frames 17 and 18, hermetically contacted to the frame 17 at the upper surface of the accommodating portion 100*h* in the upstream side (right side in FIG. 21) with respect to the developer feeding direction.

By thus-constituting the developing unit 20, a developer filling density of the developing unit 20 can be enhanced. As a result, it is possible to realize downsizing of the developing unit 20. On the other hand, a gap (spacing) Q is provided between the frame 17 and the upper surface of the accommodating portion 100*a* of the developer bag in the downstream side (left side in FIG. 21) with respect to the developer feeding direction. Other constitutions are the same as those in the above-described embodiments, and a similar effect can be obtained.

Incidentally, functions, materials, shapes and relative arrangements of constituent elements in the present invention are not limited to those in the above-described embodiments.

INDUSTRIAL APPLICABILITY

According to the present invention, even in a constitution in which the bottom of the developer bag does not have an inclination (slope) enough to permit fall (drop) of the developer by its own weight, the developer can be discharged satisfactorily. Further, also in a constitution in which the opening of the developer bag cannot be formed in the lower side with respect to the direction of gravitation, it is possible to satisfactorily discharge the developer. As a result, it is possible to reduce the amount of the developer remaining in the flexible developer bag, so that more images can be formed in the amount of the developer accommodated in the developer bag.

The invention claimed is:

1. A developing cartridge comprising:
- a flexible developer bag, provided with an opening and provided in a frame, for accommodating developer; and
- an acting member contactable to said developer bag,
- wherein said developer bag is fixed to said frame at its upper portion, and
- wherein said developer bag is swingable in a direction of the opening by contact with said acting member.

2. A developing cartridge according to claim 1, further comprising a contact projection,
- wherein said developer bag includes a contact portion, and
- wherein said contact portion of said developer bag contacts said contact projection of said developing cartridge during swing of said developer bag.

3. A developing cartridge according to claim 1, further comprising an elastic member actable on said developer bag,
- wherein an elastic force of said elastic member is accumulated and released during swing of said developer bag.

4. A developing cartridge according to claim 1, wherein in a swingable range of said developer bag, at least one space is provided between said developer bag and said frame.

5. A developing cartridge according to claim 1, wherein said acting member periodically acts on said developer bag.

6. An image forming apparatus comprising:
- a developing cartridge according to claim 1,
- wherein an image is formed on a recording material by using the developer.

7. A developing cartridge comprising:
- a flexible developer bag, provided with an opening and provided in a frame, for accommodating developer; and
- an acting member contactable to said developer bag,
- wherein said acting member is integrally provided with a contact portion contactable to said developer bag, and
- wherein said contact portion is contacted to said developer bag when said developer bag is swung toward a direction of the opening by contact with said acting member.

8. A developing cartridge according to claim 1 or 7, wherein said acting member is a feeding member for feeding developer accommodated in said developing cartridge.

9. A process cartridge detachably mountable to a main assembly of an image forming apparatus, said process cartridge comprising:
- an image bearing member for forming an electrostatic latent image on its surface;
- a frame;
- a flexible developer bag, provided with an opening and provided in said frame, for accommodating developer; and
- an acting member contactable to said developer bag,
- wherein said developer bag is fixed to said frame at its upper portion, and
- wherein said developer bag is swingable in a direction of the opening by contact with said acting member.

10. A process cartridge according to claim 9, wherein said acting member is a feeding member for feeding developer accommodated in said process cartridge.

11. A process cartridge according to claim 9, further comprising a contact projection,
- wherein said developer bag includes a contact portion, and
- wherein said contact portion of said developer bag contacts said contact projection of said process cartridge during swing of said developer bag.

12. A process cartridge according to claim 9, further comprising an elastic member actable on said developer bag,
- wherein an elastic force of said elastic member is accumulated and released during swing of said developer bag.

13. A process cartridge according to claim 9, wherein, in a swingable range of said developer bag, at least one space is provided between said developer bag and said frame.

14. A process cartridge detachably mountable to a main assembly of an image forming apparatus, said process cartridge comprising:
- an image bearing member for forming an electrostatic latent image on its surface;
- a frame;
- a flexible developer bag, provided with an opening and provided in said frame, for accommodating developer; and
- an acting member contactable to said developer bag,
- wherein said acting member is integrally provided with a contact portion contactable to said developer bag, and
- wherein said contact portion is contacted to said developer bag when said developer bag is swung toward a direction of the opening by contact with said acting member.

15. A developing cartridge comprising:
- a flexible developer bag, provided with an opening and provided in a frame, for accommodating developer; and
- an acting member contactable to said developer bag,
- wherein said developer bag is fixed to said frame in a position above the opening with respect to a direction of gravitation when said acting member is driven, and
- wherein said developer bag is swingable in a direction of the opening by contact with said acting member.

* * * * *